US009541869B2

(12) United States Patent
Hasegawa

(10) Patent No.: US 9,541,869 B2
(45) Date of Patent: Jan. 10, 2017

(54) IMAGE HEATING APPARATUS

(71) Applicant: CANON KABUSHIKI KAISHA, Tokyo (JP)

(72) Inventor: Takuya Hasegawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 14/030,208

(22) Filed: Sep. 18, 2013

(65) Prior Publication Data

US 2014/0086647 A1 Mar. 27, 2014

(30) Foreign Application Priority Data

Sep. 25, 2012 (JP) ..... 2012-210919

(51) Int. Cl.
*G03G 15/20* (2006.01)

(52) U.S. Cl.
CPC ..... *G03G 15/2053* (2013.01); *G03G 15/2017* (2013.01); *G03G 2215/2019* (2013.01)

(58) Field of Classification Search
CPC ..... G03G 15/2017; G03G 15/2053; G03G 2215/2003; G03G 2215/2019
See application file for complete search history.

(56) References Cited

U.S. PATENT DOCUMENTS 5,678,134 A * 10/1997 Miki et al. ..... 399/71
7,107,001 B2 9/2006 Kameda
7,194,233 B2 * 3/2007 Wu et al. ..... 399/328
7,603,069 B2 * 10/2009 Yamana et al. ..... 399/328
7,684,746 B2 * 3/2010 Asakura et al. ..... 399/330
7,706,707 B2 * 4/2010 Minakuchi et al. ..... 399/67
7,711,306 B2 * 5/2010 Kagawa ..... 399/330
7,890,024 B2 * 2/2011 Hirayama et al. ..... 399/122
8,331,821 B2 * 12/2012 Nakayama ..... 399/70
(Continued)

FOREIGN PATENT DOCUMENTS

CN 101017358 A 8/2007
CN 101038470 A 9/2007
(Continued)

OTHER PUBLICATIONS

Chinese Office Action dated May 28, 2015, issued in corresponding Chinese Patent Application No. 201310446412.3.
(Continued)

*Primary Examiner* — David Gray
*Assistant Examiner* — Carla Therrien
(74) *Attorney, Agent, or Firm* — Fitzpatrick, Cella, Harper & Scinto

(57) ABSTRACT

An image heating apparatus includes first and second rotatable members for heating a toner image therebetween; an endless belt for heating the first rotatable member while being rotated by the first rotatable member; first and second rollers provided inside the endless belt in this order along a rotational moving direction of the first rotatable member and for urging the endless belt toward the first rotatable member; a holding mechanism for rotatably holding the first and second rollers, the first roller being movable relative to the second roller; an urging mechanism for urging the holding mechanism toward the first rotatable member; and an urging member for urging the first roller in a direction away from the second roller.

10 Claims, 13 Drawing Sheets

(56) References Cited

U.S. PATENT DOCUMENTS

| | | | | |
|---|---|---|---|---|
| 8,364,066 | B2 * | 1/2013 | Nakamura et al. | 399/328 |
| 8,417,150 | B2 * | 4/2013 | Kameda | 399/122 |
| 8,838,002 | B2 * | 9/2014 | Takahashi | 399/330 |
| 8,942,612 | B2 * | 1/2015 | Tanaka | 399/330 |
| 2005/0214043 | A1 | 9/2005 | Kameda | |
| 2006/0245796 | A1 | 11/2006 | Wu et al. | |
| 2007/0189817 | A1 | 8/2007 | Kagawa | |
| 2007/0212094 | A1 | 9/2007 | Asakura et al. | |
| 2007/0217838 | A1 | 9/2007 | Yamana et al. | |
| 2013/0209145 | A1 | 8/2013 | Hasegawa | |
| 2014/0093287 | A1 * | 4/2014 | Hasegawa | 399/328 |
| 2014/0153947 | A1 * | 6/2014 | Hasegawa | 399/67 |
| 2014/0153981 | A1 * | 6/2014 | Hasegawa | 399/329 |
| 2014/0224623 | A1 * | 8/2014 | Hasegawa | 198/790 |
| 2014/0226998 | A1 * | 8/2014 | Hasegawa | 399/67 |

FOREIGN PATENT DOCUMENTS

| | | | |
|---|---|---|---|
| CN | 101038477 | A | 9/2007 |
| JP | 2005-316421 | A | 11/2005 |
| JP | 2007212896 | A | 8/2007 |
| JP | 2007334193 | A | 12/2007 |
| JP | 2010-134072 | A | 6/2010 |
| JP | 2011221438 | A | 11/2011 |

OTHER PUBLICATIONS

Japanese Office Action issued in corresponding Japanese Application No. 2012-210919 dated Jul. 5, 2016.

* cited by examiner (a)

(b)

(a)

(b)

IMAGE HEATING APPARATUS

FIELD OF THE INVENTION AND RELATED ART

The present invention relates to an image heating apparatus (device) which heats a toner image on a sheet of recording medium.

In recent years, a fixing apparatus (image heating apparatus) mounted in an electrophotographic image forming apparatus has been increased in process speed, and also, has come to be required to deal with a thick sheet of recording medium (card stock or the like). Thus, it has become rather difficult to keep the fixation roller (rotational component) stable in temperature at a proper level. Thus, in the case of the fixing apparatus disclosed in Japanese Laid-open Patent Application No. 2005-316421, it is provided with an external heating means (two external heat rollers) which are placed in contact with the peripheral surface of the fixation roller to heat the fixation roller.

Further, in the case of the fixing apparatus disclosed in Japanese Laid-open Patent Application No. 2010-134072, it employs an external heat belt. More concretely, an external heat belt is suspended and kept stretched by a pair of two rollers, and is placed in contact with the fixation roller to create an area of contact, between itself and fixation roller, in which the external heat belt can heat the fixation roller. Thus, this fixing apparatus which employs an external heat belt can heat the fixation roller more efficiently than the fixing device which employs the pair of external heat rollers.

SUMMARY OF THE INVENTION

The object of the present invention is to improve the fixing device disclosed in Japanese Laid-open Patent Application No. 2010-134072.

According to an aspect of the present invention, there is provided an image heating apparatus comprising first and second rotatable members configured and positioned to heat a toner image on a sheet therebetween; an endless belt configured and positioned to heat an outer surface of said first rotatable member while being rotated by rotation of said first rotatable member; first and second rollers provided inside said endless belt in this order along a rotational moving direction of said first rotatable member and configured and positioned to urge said endless belt toward said first rotatable member; a holding mechanism configured and positioned to rotatably hold said first roller and said second roller, said first roller being movable relative to said second roller; an urging mechanism configured and positioned to urge said holding mechanism toward said first rotatable member; and an urging member configured and positioned to urge said first roller in a direction away from said second roller.

Further features of the present invention will become apparent from the following description of exemplary embodiments with reference to the attached drawings.

DESCRIPTION OF THE PREFERRED EMBODIMENTS

Hereinafter, the embodiments of the present invention are described in detail with reference to the appended drawings.

<Image Forming Apparatus>

Figure 1:
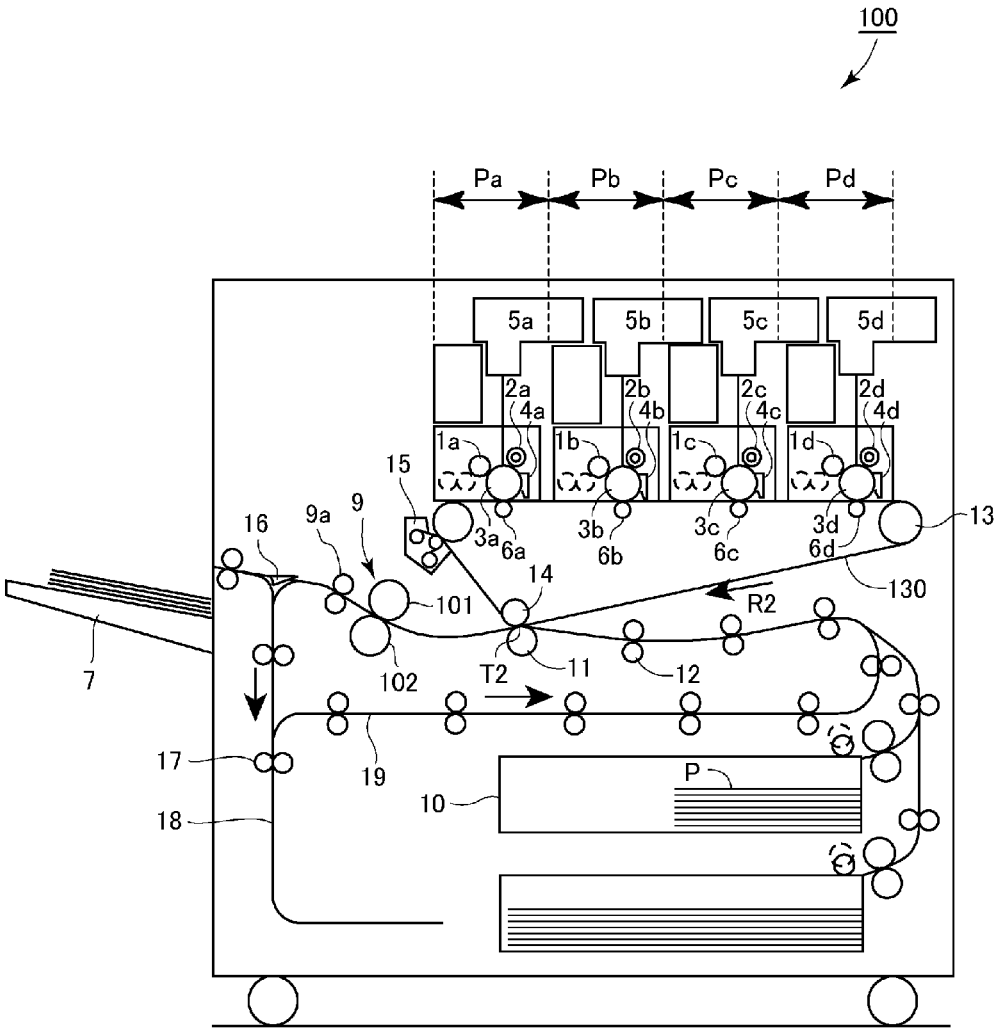
FIG. 1 is a schematic sectional view of a typical image forming apparatus to which the present invention is applicable. It shows the general structure of the apparatus.

Referring to FIG. 1 which is a drawing for describing the structure of an image forming apparatus, the image forming apparatus 100 is a full-color printer of the tandem type, and also, of the intermediary transfer type. That is, it has an intermediary transfer belt 130, and yellow, magenta, cyan, and black image formation sections Pa, Pb, Pc and Pd, respectively, which are aligned in tandem along the intermediary transfer belt 130.

In the image formation section Pa, a yellow toner image is formed on the photosensitive drum 3*a*, and is transferred (primary transfer) onto the intermediary transfer belt 130. In the image formation section Pb, a magenta toner image is formed on the photosensitive drum 3*b*, and is transferred (primary transfer) onto the intermediary transfer belt 130. In the image formation sections Pc, and Pd, cyan toner image and black toner image are formed on the photosensitive drums 3*c* and 3*d*, respectively, and are sequentially transferred (primary transfer) onto the intermediary transfer belt 130.

Each of the sheets P of recording medium in a recording medium cassette 10 is taken out of the cassette 10 one by one, and is kept on standby at a pair of registration rollers 12, which convey each sheet P of recording medium to the secondary transfer station T2, with such a timing that the sheet P arrives at the same time as the toner images on the intermediary transfer belt 130. Then, the sheet P is conveyed through the secondary transfer station T2. While the sheet P is conveyed through the secondary transfer station T2, the four toner images, different in color, on the intermediary transfer belt 130 are transferred (secondary transfer) onto the sheet P. Then, the sheet P is conveyed to the fixing device 9, in which the sheet P and the toner images thereon are subjected to heat and pressure. Thus, the toner images become fixed to the sheet P. Then, the sheet P is discharged into the tray 7 which is outside the main assembly of the image forming apparatus 100.

In a case where the image forming apparatus 100 is in the two-sided printing mode, after the fixation of the toner images onto the first surface of the sheet P of recording medium by the fixing device 9, the sheet P is guided by the flapper 16, into the reversal passage 18 in which the sheet P is guided by the reversal roller 17 into the two-sided print passage 19. Then, the sheet P is again kept on standby by the registration rollers 12. Then, it is sent by the registration rollers 12 into the secondary transfer station T2, in which toner images are transferred onto the second surface of the sheet P. Then, the transferred toner images on the second surface of the sheet P are fixed by the fixing device 9. Then, the sheet P, which has fixed toner images on both of its first and second surfaces, is discharged into the external tray 7.

The image formation sections Pa, Pb, Pc and Pd are virtually the same in structure, although their developing devices 1*a*, 1*b*, 1*c* and 1*d*, respectively, are different in the color of the toner they use. Thus, only the image formation section Pa is described in order to not repeat the same description.

The image formation station Pa is made up of the photosensitive drum 3*a*, and drum processing means, more specifically, charge roller 2*a*, exposing device 5*a*, developing device 1*a*, a primary transfer roller 6*a*, and a drum cleaning device 4*a*, which are disposed in the adjacencies of the peripheral surface of the photosensitive drum 3*a*. The photosensitive drum 3*a* is made up of a cylindrical substrate formed of aluminum, and a photosensitive layer formed on the peripheral surface of the cylindrical substrate.

The charge roller 2*a* uniformly charges the peripheral surface of the photosensitive drum 3*a* to a preset potential level. The exposing device 5*a* writes an electrostatic image of the image to be formed, on the peripheral surface of the photosensitive drum 3*a*, by scanning the peripheral surface of the photosensitive drum 3*a* with the beam of layer light it emits. The developing device 1*a* develops the electrostatic image on the peripheral surface of the photosensitive drum 3*a* into a toner image. The primary transfer roller 6*a* transfers (primary transfer) the toner image on the peripheral surface of the photosensitive drum 3*a*, by being supplied with electrical voltage.

The drum cleaning device 4*a* recovers the transfer residual toner, that is, the toner which has escaped from being transferred onto the intermediary transfer belt 130 and is remaining adhered to the peripheral surface of the photosensitive drum 3*a*, by rubbing the peripheral surface of the photosensitive drum 3*a* with its cleaning blade. The belt cleaning device 15 recovers the transfer residual toner, that is, the toner which has escaped from being transferred onto a sheet P of recording medium in the secondary transfer station T2, and is remaining adhered to the intermediary transfer belt 130.

<Fixing Device>

Figure 2:
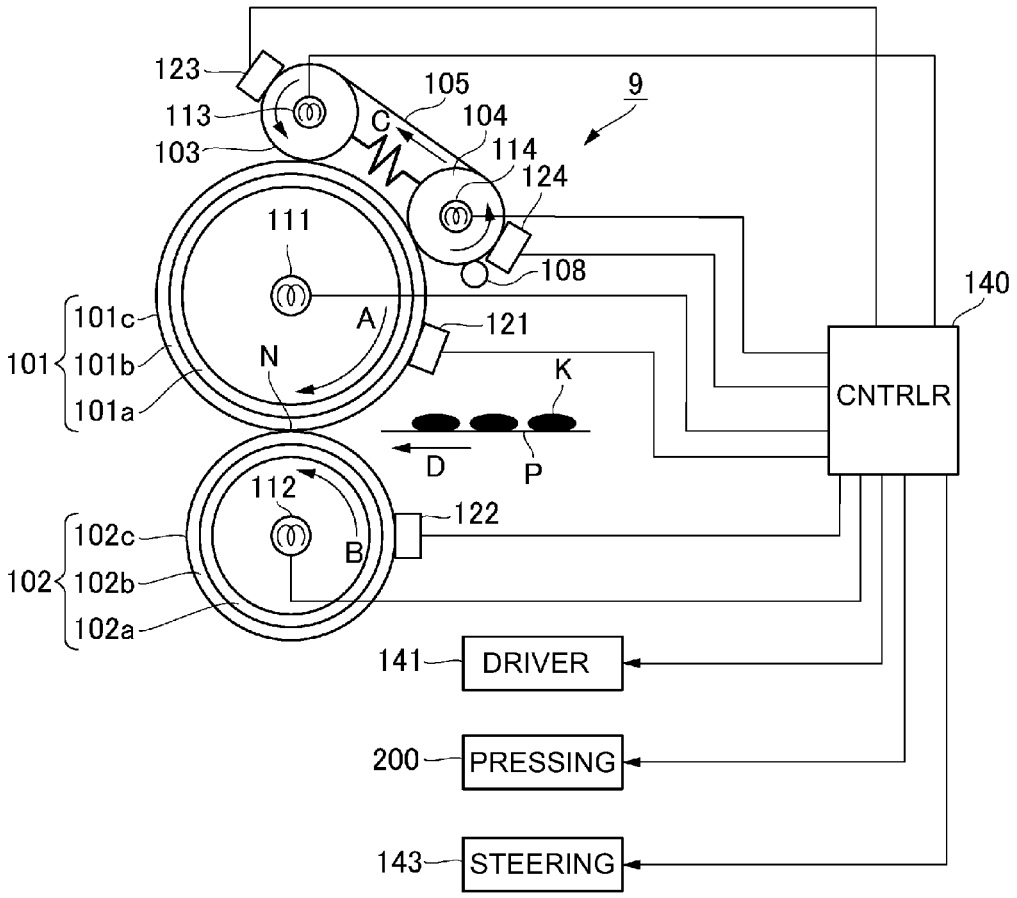
FIG. 2 is a schematic sectional view of the fixing device in the first embodiment of the present invention. It shows the general structure of the fixing device.

Referring to FIG. 2 which is a drawing for describing the structure of the fixing device (image heating device) 9 in the first embodiment of the present invention, the fixing device 9 has a pair of rotational components, more specifically, a fixation roller 101 and a pressure roller 102. The two rollers 101 and 102 are disposed so that they press upon each other, forming thereby a nip N. The nip N is where a sheet P of recording medium, by which an unfixed toner K is borne, is conveyed while remaining pinched by the two rollers 101 and 102, and the toner K is fixed (thermally welded) to the sheet P. The fixation roller 101 is made up of a metallic core 101*a*, an elastic layer 101*b* formed on the peripheral surface of the metallic core 101*a*, and a parting layer 101*c* formed on the peripheral surface of the elastic layer 101*b*. The fixation roller 101 is rotationally driven in the direction indicated by an arrow mark A, at a preset process speed, by a driving mechanism 141 which includes a motor and a gear train.

The pressure roller 102 is made up of a metallic core 102*a*, an elastic layer 102*b* formed on the peripheral surface of the metallic core 102*a*, and a parting layer 102*c* formed on the peripheral surface of the elastic layer 102*b*. The pressure roller 102 is rotated in the direction indicated by an arrow mark B, at a preset process speed by the driving mechanism 141. The pressure roller 102 is placed in contact with, or separated from, the fixation roller 101 by an unshown pressure application mechanism which employs an eccentric cam. The unshown pressure application mechanism forms a nip N between the pressure roller 102 and fixation roller 101, by pressing the pressure roller 102 upon the fixation roller 101 with the application of a preset amount of pressure.

A halogen heater 111 is stationarily disposed in the hollow of the metallic core 101*a* of the fixation roller 101. A thermistor 121 is disposed in contact with the fixation roller 101 to detect the surface temperature of the fixation roller 101. A control section 140 keeps the surface temperature of the fixation roller 101 at a preset target level, which corresponds to the recording medium type, by turning on or off the halogen heater 111 in response to the temperature of the fixation roller 101 detected by the thermistor 121.

A halogen heater 112 is stationarily disposed in the hollow of the metallic core 102*a* of the pressure roller 102. A thermistor 122 is disposed in contact with the pressure roller 102 to detect the surface temperature of the pressure roller 102. A control section 140 keeps the surface temperature of the pressure roller 102 at a preset target level, which corresponds to the recording medium type, by turning on or off the halogen heater 112 in response to the temperature of the pressure roller 102 detected by the thermistor 122.

<External Heat Belt>

Figure 3:
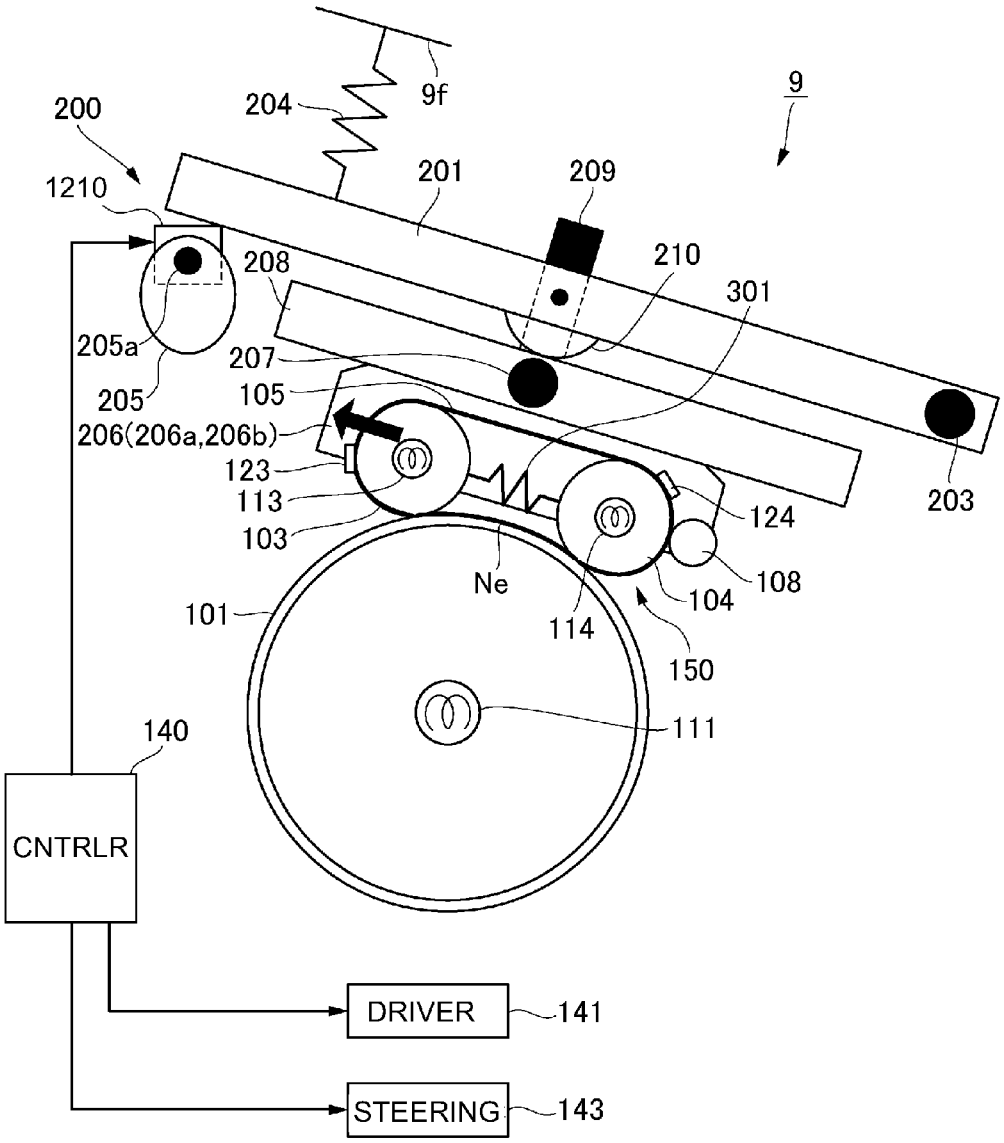
FIG. 3 is drawing for describing the mechanism for keeping the external heat belt in contact with the fixation roller, or separating (and keeping separated) the external heat belt from the fixation roller.
Figure 4:
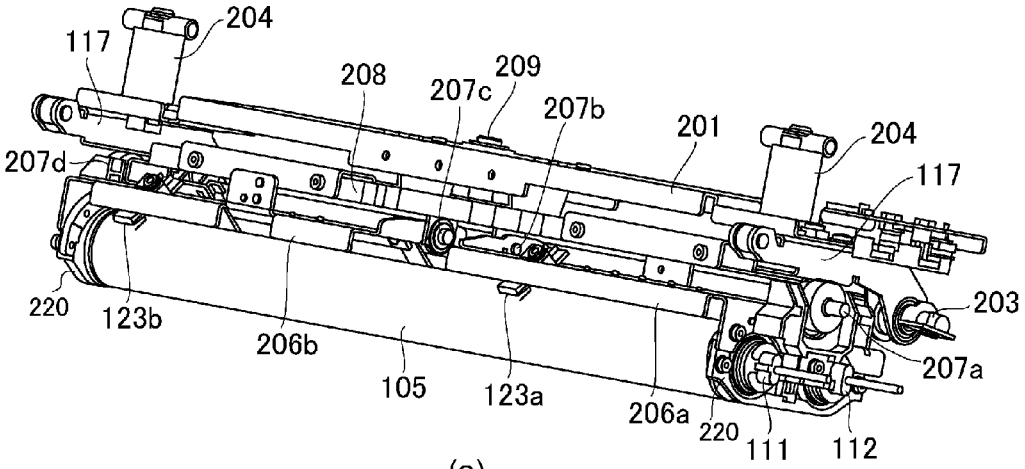
FIG. 4 is an external perspective view of the external heat belt.
Figure 4:
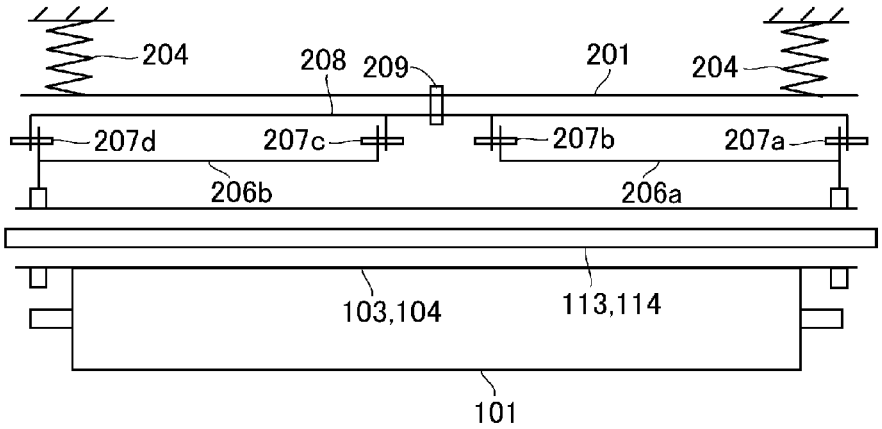
Figure 5:
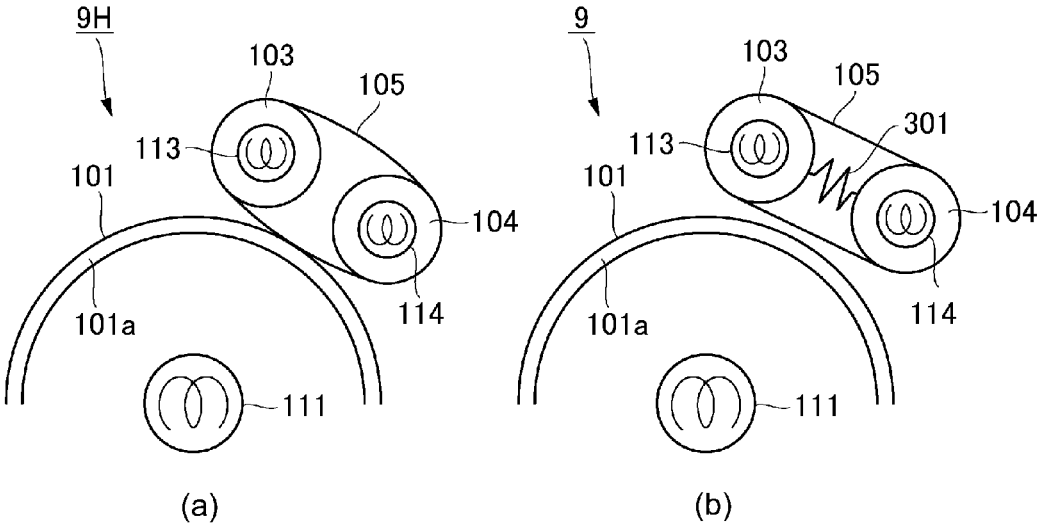
FIG. 5 is a drawing for describing the structural arrangement for suspending, and keeping tensioned, the external heat belt.

FIG. 3 is a drawing for describing the mechanism for placing the external heat belt in contact with, or moving away from, the fixation roller 101. FIG. 4 is an external perspective view of the external heating unit. FIG. 5 is a drawing for describing the slacking of the external heat belt of the first example of fixing device comparable to the fixing device 9 in accordance with the present invention.

An image forming apparatus is required of a high level of productivity (print count per unit length of time) even if the recording medium used for image formation is a sheet of cardstock, which is relatively large in basis weight (weight per unit area). Thus, one of the desirable methods for increasing an image forming apparatus in productivity is to increase the fixing device of the image forming apparatus in the speed with which it processes each sheet P of recording medium. However, recording medium which is large in basis weight is substantial in the amount of heat it robs from the fixing device. Thus, the amount of heat required to fix an unfixed toner image on a sheet of recording medium which is substantial in basis weight is substantially larger than that required to fix an unfixed toner image on a sheet of recording medium which is less in basis weight. Therefore, the fixing device 9 is structured so that the external heat belt (endless belt) 105 can be placed in contact with, or separated from, the fixation roller 101. The fixation roller 101 is externally heated by the pressing of the external heat belt 105 upon the peripheral surface of the fixation roller 101.

Referring to FIG. 3, the fixation roller 101 which is an example of a heat roller, heats the image bearing surface of a sheet P of recording medium. The external heat belt 105 heats the peripheral surface of the fixation roller 101. The external heat belt 105 is suspended, and kept stretched, by upstream and downstream rollers 103 and 104, respectively, positioned on the inward side of the loop which the external heat belt 105 forms, in the listed order in terms of the rotational direction of the external heat belt 105. This structural arrangement which employs the external heat belt 105 as the means for externally heating the fixation roller 101 in addition to the upstream and downstream rollers 103 and 104 is higher in the efficiency with which the fixation roller 101 can be externally heated, than a structural arrangement which employs only the upstream and downstream rollers for externally heating the fixation rollers 101, because the former is greater in the area of contact between the external means for heating the fixation roller 101, and the fixation roller 101, than the latter.

The external heat belt 105 is an endless belt for externally heating the fixation roller 101. It is placed in contact with the peripheral surface of the fixation roller 101, forming thereby a nip Ne. It is made up of a substrative layer made of metal such as stainless steel or nickel, or resin such as polyimide, and a heat resistant surface layer formed of fluorinated resin, on the outward surface of the substrative layer to prevent toner from adhering to the external heat belt 105. As the fixation roller 101 rotates, the external heat belt 105 is rotated in the direction indicated by an arrow mark C, by the friction between the fixation roller 101 and external heat belt 101.

A heater (halogen heater) 113, which is an example of a means for heating the upstream roller, heats the upstream roller 103 to a preset temperature level. The upstream roller 103 is made up of a cylindrical hollow component formed of a metallic substance such as aluminum, iron, stainless steel, etc., which is high in thermal conductivity, and a surface layer formed on the peripheral surface of the cylindrical component by coating the peripheral surface of the cylindrical component with a substance such rubber, resin, etc., which are excellent in terms of parting properties. The aforementioned halogen heater 113 is stationarily disposed at the center of the hollow of the upstream roller 103, in terms of the radius direction of the roller 103, in such a manner that it extends from one lengthwise end of the roller 103 to the other. A thermistor 123 is disposed so that it remains in contact with the portion of the external heat belt 105, which is in contact with the upstream roller 103. It detects the temperature of the upstream roller 103. The control section 140 keeps the temperature of the upstream roller 103 at the preset target level, by turning on or off the halogen heater 113 in response to the temperature of the upstream roller 103 detected by the thermistor 123.

A heater (halogen heater) 114, which is an example of a means for heating the downstream roller 104, heats the downstream roller 104 to a preset temperature level. The downstream roller 104 is made up of a cylindrical hollow component formed of a metallic substance such as aluminum, iron, stainless steel, etc., which is high in thermal conductivity, and a surface layer formed on the peripheral surface of the cylindrical component by coating the peripheral surface of the cylindrical component with a substance such rubber, resin, etc., which is excellent in terms of parting properties. The aforementioned halogen heater 114 is stationarily disposed at the center of the hollow of the downstream roller 104, in terms of the radius direction of the roller 104, in such a manner that it extends from one lengthwise end of the roller 104 to the other. A thermistor a thermistor 124 is disposed so that it remains in contact with the portion of the external heat belt 105, which is in contact with the downstream roller 104, and detects the temperature of the downstream roller 104. The control section 140 keeps the temperature of the downstream roller 104 at the preset target level, by turning on or off the halogen heater 114 in response to the temperature of the downstream roller 104 detected by the thermistor 124.

The target temperature levels set for controlling the upstream and downstream rollers 103 and 104 in temperature is set higher than the target temperature level for controlling the temperature of the fixation roller 101, for the reason that when the surface temperatures of the upstream roller 103 and downstream roller 104 are higher than the surface temperature of the fixation roller 101, the efficiency with which heat is transferred from the upstream and downstream rollers 103 and 104 to the fixation roller 101, as the fixation roller 101 reduces in surface temperature, is higher than when the upstream and downstream rollers 103 and 104 are the same in surface temperature as the fixation roller 101. For example, in a case where the target temperature level for the fixation roller 101 is set to 165° C. in an image forming operation in which cardstock is used as recording medium, the target temperature levels for the upstream and downstream roller 103 and 104 are set to 230° C. That is, the surface temperatures of the upstream and downstream rollers 103 and 104 are kept higher by 75° C. than the surface temperature of the fixation roller 101.

While the fixing device 9 is kept on standby for the next image formation job, the external heat belt 105 is kept separated from the fixation roller 101. Referring to FIG. 1, as an image formation start command is transmitted to the image forming apparatus 100, preparatory operations are initiated by various devices in the image forming apparatus 100; the heating operation is started in the fixing device 9. As the temperatures of the fixation roller 101, pressure roller 102, upstream roller 103, and downstream roller 104 reach their target levels, the external heat belt 105 is pressed upon the peripheral surface of the fixation roller 101, and the image formation job is started. Then, as the image formation job is completed, the external heat belt 105 is separated from the fixation roller 101, and is kept separated from the fixation roller 101 until the starting of the next image formation job.

Next, referring to FIG. 4, the external heat belt 105 forms the nip Ne between itself and fixation roller 101. The external heat belt 105 is supported by the upstream and downstream rollers 103 and 104 in such a manner that it is circularly moved by the rotation of the fixation roller 101.

The external heat belt 105 is enabled to take a position in which it is kept in contact with the fixation roller 101 by a belt positioning mechanism 200, and a position in which it is kept away from the fixation roller 101 by the belt positioning mechanism 200. The belt positioning mechanism 200 doubles as the mechanism for keeping the upstream and downstream rollers 103 and 104 pressed against the fixation roller 101 with the presence of the external heat belt 105 between the two rollers 103 and 104, and the fixation roller 101. A pressure application frame (pressing mechanism) 201 is pivotally movable relative to the frame 9*f* of the fixing device 9, about a shaft (pivot) 203 by which the pressure application frame 201 is supported.

There is disposed a compression spring (pressure application mechanism) 204 between the opposite end portion of the pressure application frame 201 from the shaft (pivot) 203, and the fixing device frame 9*f*. The compression spring 204 presses the opposite end portion of the pressure application frame 201 from the shaft 203, pressing thereby the upstream and downstream rollers 103 and 104 against the fixation roller 101. The total amount of pressure, which the compression spring 204 generates between the upstream and downstream rollers 103 and 104, and the fixation roller 101, with the presence of the external heat belt 105 between the two rollers 103 and 104, and the fixation roller 101, is 392N (roughly 40 kgf).

A pressure removal cam 205 is in contact with the bottom surface of the opposite end portion of the pressure application frame 201 from the shaft 203. The control section 140 causes the opposite end portion of the pressure application frame 201 from the shaft 201, to move upward or downward by rotating the pressure removal cam 205 about the shaft 205*a*. As the pressure application cam 205 is kept separated from the pressure application frame 201, the compression spring 204 presses downward the opposite end portion of the pressure application frame 201 from the shaft 203, causing thereby the external heat belt 105 to be pressed upon the fixation roller 101. As the pressure removal cam 205 moves upward the pressure application frame 210 while compressing the compression spring 204, the external heat belt 105 is separated from the fixation roller 101.

Referring to FIG. 3, while the external heat belt 105 is airtightly in contact with the fixation roller 101, the straight line which connects the center of the shaft 207 and the center of the fixation roller 101 is perpendicular to the straight line which connects the center of the upstream roller 103 and the center of the downstream roller 104, and bisects this straight line. An oscillatory frame 208 is rotatably supported by a pair of intermediary rollers 210, which are located at the front and rear ends of the fixing device 9, in such a manner that the oscillatory frame 208 can be pivotally moved relative to the pressure application frame 201. Therefore, the amount of the pressure by which the upstream roller 103 is pressed again the fixation roller 101 is roughly equal to the amount of the pressure by which the downstream roller 104 is pressed against the fixation roller 101.

Next, referring to FIG. 4(*a*), a roller supporting frame (206 in FIG. 3) which functions as a roller supporting mechanism is made up of two sections, that is, roller supporting frames 206*a* and 206*b*, which support the upstream and downstream rollers 103 and 104, on the front and rear sides of the fixing device 9, respectively. That is, the front end portion of the upstream downstream roller 103 and the front end portion of the downstream roller 104 are supported by the roller supporting frame 206*a*, whereas the rear end portion of the upstream roller 103 and the rear end portion of the down stream roller 104 are supported by the roller supporting frame 206*b*.

Next, referring to FIG. 4(*b*), the roller supporting frame 206*a*, which is on the front side of the fixing device 9, is supported by the shafts 207*a* and 207*b* supported by the oscillatory frame 208, so that the roller supporting frame 206*a* is pivotally movable about the shafts 207*a* and 207*b*, being thereby allowed to change in its attitude relative to the oscillatory frame 208. As for the roller supporting frame 206*b*, which is on the rear side of the fixing device 9, it is pivotally supported by shafts 207*c* and 207*d*, being thereby allowed to change in its attitude relative to the oscillatory frame 208. There are disposed a pair of compression springs 204 at the lengthwise ends of the pressure application frame 201, one for one. The pair of compression springs 204 apply a preset amount of pressure to the peripheral surface of the fixation roller 101, with the presence of the external heat belt 105, and upstream and downstream rollers 103 and 104 between themselves and the fixation roller 101, in order to keep the external heat belt 105 in contact with the peripheral surface of the fixation roller 101.

<Comparison of Fixing Device in First Embodiment to First Example of Comparative Fixing Device>

By the way, in a case of the fixing device 9 in this embodiment which employs the external heat belt 105, in order to ensure that the fixation roller 101 remains stable in its surface temperature, it is important that the external heat belt 105 is kept airtightly in contact with the peripheral surface of the fixation roller 101 (across entirety of area of contact between external heat belt 105 and fixation roller 101, and with no interruption). If the contact between the fixation roller 101 and external heat belt 105 fails to remain airtight, it becomes impossible for heat to be supplied from the external heat belt 105 to the fixation roller 101 by a sufficient amount. Consequently, the fixation roller 101 reduces in surface temperature, which causes the image forming apparatus 100 to reduce in image quality; the image forming apparatus 100 outputs images which are nonuniform in glossiness, and/or toner fails to be satisfactorily fixed to recording medium.

However, when the image forming apparatus 100 is kept on standby while it is waiting for an image formation command, it is desired that the external heat belt 105 remains completely separated from the fixation roller 101, and the fixation roller 101 is kept as high as possible in temperature by being heated by the heater (halogen heater) 111 placed in the fixation roller 101. If the metallic core 101*a* is low in temperature, except for its surface layer which is kept high in temperature by the external heat belt 105, the fixation roller 101 abruptly drops in temperature as it comes into contact with recording medium.

Referring to FIG. 5(*a*), the fixing device 9H, which is the first example of comparative fixing device is structured so that the external heat belt 105 is used to supply the fixation roller 101 with heat. However, it does not have a component which can keep the external heat belt 105 tensioned. Therefore, in the case of the fixing device 9H, or the first example of comparative fixing device, as the external heat belt 105 is moved away from the fixation roller 101 while the fixing device 9H is kept on standby, the external heat belt 105 which is suspended by the upstream and downstream rollers 105 and 104 slackens. More concretely, while the external heat belt 105 is kept pressed upon the fixation roller 101, the external heat belt 105 remains airtightly in contact with the fixation roller 101. However, as the pressure applied to keep the external heat belt 105 is removed, the external heat belt 105 slackens. Therefore, in the case of the fixing device 9H, ore the first example of comparative fixing device, the distance, by which the external heat belt 105 is to be kept separated from the fixation roller 101 while it is not necessary for the external heat belt 105 to heat the fixation roller 101, has to be larger than that for the fixing device 9 in this embodiment. However, increasing the distance by which the external heat belt 105 is to be kept separated from the fixation roller 101 requires the space for the external heat belt 105 to be increased, which is problematic in that the fixing device has to be increased in size; the fixing device 9H is larger than the fixing device 9 in this embodiment.

In this embodiment, therefore, in order to make the fixing device 9 smaller, in the amount by which the external heat belt 105 slackens as it is separated from the fixation roller 101, than the fixing device 9H, or the first example of comparative fixing device, a pair of compression springs which function as a pressure generating components are disposed between the two rollers by which the external heat belt 105 is suspended. Further, the downstream roller, in terms of the rotational direction of the fixation roller 101, of the two rollers by which the external heat belt 105 is suspended, is made changeable in position. Therefore, the fixing device 9 in this embodiment is smaller in the distance by which the external heat belt 105 has to be moved to be kept completely separated from the fixation roller 101, and also, in the amount of pressure necessary to keep the external heat belt 105 airtightly in contact with the fixation roller 101, than the fixing device 9H, or the first example of comparative fixing device. Further, the fixing device 9 in this embodiment is smaller in the fluctuation of the tension of the external heat belt 105 than the fixing device 9H. Therefore, the former is more stable in the circular movement of the external heat belt 105 than the latter.

Embodiment 1

Figure 6:
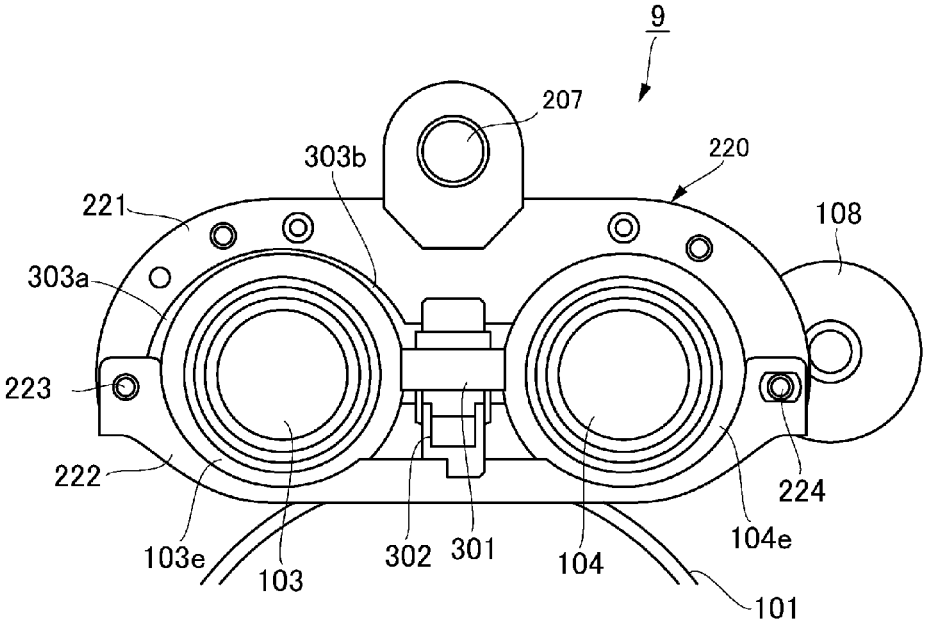
FIG. 6 is a drawing for describing the structural arrangement for providing the external heat belt with a preset amount of tension.
Figure 7:
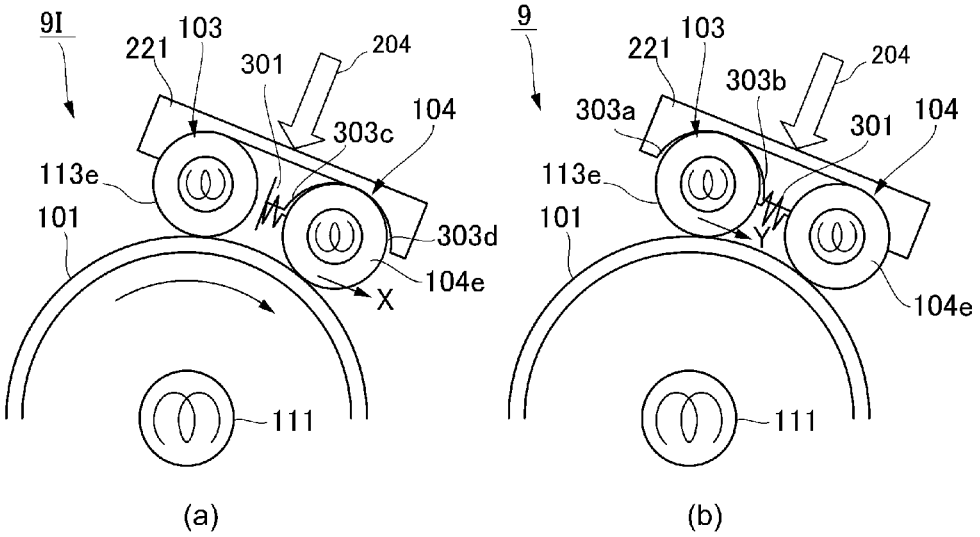
FIG. 7 is drawing for describing the difference between the structural arrangement which keeps the upstream roller fixed in position while allowing the downstream roller to change in position, and the structural arrangement which keeps the downstream roller fixed in position while allowing the upstream roller to change in position.

FIG. 6 is a drawing for describing the structural arrangement, in the first embodiment of the present invention, for keeping the external heat belt suspended while providing it with a preset amount of tension. FIG. 7 is a drawing for describing the difference between the structural arrangement which keeps the upstream roller fixed in position while allowing the downstream roller to change in position, and the structural arrangement which keeps the downstream roller fixed in position while allowing the upstream roller to change in position.

Referring to FIG. 3, in the first embodiment, the fixation roller 101, which is an example of a rotational component, rotates while remaining in contact with a sheet of recording medium. The pressure application mechanism 200, which is an example of a mechanism for placing the external heat belt in contact with the fixation roller 101, or separating the external heat belt 105 from the fixation roller 101, moves a bearing holder 220 (FIG. 6) upward or downward to place the external heat belt 105 in contact with the fixation roller 101, or separate the external heat belt 101 from the fixation roller 101, respectively. The external heat belt 105, which is an example of an endless belt, is suspended and kept stretched by the upstream and downstream rollers 103 and 104. The upstream roller 103, which is an example of an upstream rotational component, suspends, and keeps stretched, the external heat belt 105, at the upstream end of the area of contact between the fixation roller 101 and external heat belt 105. The downstream roller 104, which is an example of a downstream rotational component, suspends, and keeps stretched, the external heat belt 105, at the downstream end of the area of contact between the fixation roller 101 and external heat belt 105. The external heat belt 105 forms an area of contact between itself and the peripheral surface of the fixation roller 101, and transfers heat to the fixation roller 101 through the area of contact, to heat the fixation roller 101.

Next, referring to FIG. 6, the bearing holder 220, which is an example of a roller supporting component (holding mechanism), supports the axle of the upstream roller 103 in such a manner that the upstream roller 103 is allowed to change in position in the direction of the circular movement of the external heat belt 105, in parallel to the area of contact between the external heat belt 105 and the peripheral surface of the fixation roller 101, whereas it supports the axle of the downstream roller 104 in such a manner that the downstream roller 104 is not allowed to change in position. The bearing holder 220 is made up of two sections, that is, the section which is on the top side of the line which connects the rotational axis of the upstream roller 103 and that of the downstream roller 104, and the section which is on the bottom side of the line, so that the bearings for the upstream roller 103 and the bearings for the downstream roller 104 can be removed from the bearing holder 220.

The compression spring (coil spring) 301 which is an example of a pressure generating component presses the upstream roller 103 in the direction to move the roller 103 away from the downstream roller 104. The compression spring 301 is placed between the bearing for the upstream roller 103 and the bearing for the downstream roller 104 so that it exerts its force upon both bearings. The compression spring 301 is supported by the opposite one of the aforementioned two sections of the bearing holder 220, from the fixation roller 101. The compression spring 301 is stationarily disposed between the bearing for the upstream roller 103 and the bearing for the downstream roller 104.

Next, referring to FIG. 5(*b*), in the first embodiment, in order to prevent the external heat belt 105 from slackening when the external heat belt 105 is separated from the fixation roller 101, the external heat belt 105 is kept tensioned by the placement of the compression spring 301 between the bearing for the upstream roller 103 and the bearing for the downstream roller 104. Since the compression spring 301 is disposed so that it acts on both the bearing for the upstream roller 103 and the bearing for the downstream roller 104 as described above, a spring seat such as the one with which a conventional fixing device is provided to support one end of the compression spring 301 is unnecessary. Therefore, the structural arrangement, in this embodiment, for keeping the external heat belt 105 tensioned while the external heat belt 105 is kept separated from the fixation roller 101 is simpler than that in accordance with the prior art. In this case, it does not matter which of the upstream and downstream rollers 103 and 104 is allowed to change in position. However, it is preferable that the upstream roller 103 is allowed to change in position, as will be described later.

In the case of the fixing device 9, in this embodiment, structured to heat its fixation roller 101 with the use of the external heat belt 105, the external heat belt 105 is kept tensioned by the placement of a means for tensioning the external heat belt 105, between the axle of the upstream roller 103 and the axle of the downstream roller 104. Further, the axle of the downstream roller 104 is fixed (held) so that it is virtually unchangeable in position, and the axle of the upstream roller 103 is held so that it can be moved toward, or away from, the downstream roller 104, to minimize the distance by which the external heat belt 105 has to be moved away from the fixation roller 101 to be kept completely separated from the peripheral surface of the fixation roller 101. Therefore, the amount of pressure to be applied to keep the external heat belt 105 airtightly in contact with the fixation roller 101, in this embodiment, does not need to be as high as that to be applied to keep the external heat belt 105 of the fixing device 9H, or the first example of comparative fixing device. Further, the external heat belt 105 in this embodiment is stabler in its circular movement than the external heat belt 105 of the first comparative fixing device 9H.

Referring to FIG. 4, the bearing holder 220 is fixed to the roller supporting frame 206*a* and 206*b*.

Next, referring to FIG. 6, the upstream and downstream rollers 103 and 104 are rotatably supported by the bearing holder 220, with the placement of a thermally insulative bushings and bearings 103*e* and 104*e* between the two rollers 103 and 104 and the bearing holder 220, respectively. The compression spring 301 is for providing the pressure which acts in the direction to widen the distance between the upstream roller 103 and downstream roller 104.

The bearing holder 220 holds the bearing 103*e* for the upstream roller 103, and the bearing 104*e* for the downstream roller 104, between the top and bottom sections 221 and 222. As a connective pin 224 is removed, the bottom section 222 of the bearing holder 220 can be pivotally moved about a shaft (pivot) 223 to allow the bearings 103*e* and 104*e* to be removed. Next, referring to FIG. 4(*a*), the roller holding frame 206*b* also is structured like the roller holding frame 206*a* so that the bearings 103*e* and 104*e* are held by the bearing holder 220. The compression spring 301 is held by a spring holder 302 so that the compression spring 301 is controlled in the direction in which it is allowed to expand, or to be compressed. The spring holder 302 is fixed to the top section 221 of the bearing holder 220, but is enabled to be engaged with, or disengaged from, the bottom section 222 of the bearing holder 220. Therefore, the spring holder 302 does not prevent the bottom section 222 of the bearing holder 220 from being pivotally moved.

The bearing 103*e* for the upstream roller 103 is loosely confined by the top and bottom sections 221 and 222 of the bearing holder 220. There is provided gaps 303*a* and 303*b* between the bearing 103*e* and top section 221, allowing thereby the bearing 103*e* to horizontally move when the external heat belt 105 is placed in contact with, or separated from, the fixation roller 101.

The bearing 104*e* for the downstream roller 104 is firmly confined by the top and bottom sections 221 and 222 of the bearing holder 220. That is, no gap is provided between the bearing 104*e* and the top section 221. Thus, the axial line of the bearing 104*e* is not movable at all relative to the bearing holder 220.

As the external heating unit in the first embodiment is moved toward the fixation roller 101 to place the external heat belt 105 in contact with the fixation roller 101, the bearing holder 220 allows the upstream roller 103 to moves downstream in terms of the rotational direction of the fixation roller 101, while it does not allow the downstream roller 104 to change in position. Thus, it can be prevented that when the external heating unit is moved away from the fixation roller 101, the external heat belt 105 slackens and remains in contact with the fixation roller 101 as shown in FIG. 5(*a*).

In comparison, referring to FIG. 5(*a*), the fixing device 9H which is the first example of comparative fixing device is not structured to increase the distance between the upstream roller 103 and downstream roller 104 to provide the external heat belt 105 with tension as the external heat belt 105 is separated from the fixation roller 101. That is, the distance between the two rollers 103 and 104 remains unchanged. Therefore, as the external heat belt 105 is moved away from the fixation roller 101, it slackens, sagging toward the fixation roller 101. That is, in the case of the comparative fixing device 9H, the distance by which the external heating unit of the fixing device 9H has to be moved away from the fixation roller 101 to completely separate the external heat belt 105 from the fixation roller 101 is greater than in the case of the external heating unit of the fixing device 9 in this embodiment. Thus, the fixing device 9H has to be taller than the fixing device 9.

Referring to FIG. 5(*b*), the fixing device 9 in the first embodiment is structured so that as the external heating unit is moved away from the fixation roller 101, the distance between the upstream roller 103 and downstream roller 104 is increased to tension the external heat belt 105. Thus, as the external heat belt 105 is moved away from the fixation roller 101, the distance between the upstream roller 103 and downstream roller 104 is increased, whereby the external heat belt 105 is pulled by the upstream roller 103 and downstream roller 104 in the direction parallel to the line tangential to the upstream roller 103 and downstream roller 104, being thereby not allowed to slacken. Therefore, the fixing device 9 in this embodiment is smaller in the distance by which the external heating unit has to be moved away to completely separate the external heat belt 105 from the fixation roller 101 than the fixing device 9H which is the first example of comparative fixing device.

As the external heat belt 105 is moved away from the fixation roller 101, the bearing holder 220 in the first embodiment allows the upstream roller 103 to move upstream in terms of the rotational direction of the fixation roller 101 without allowing the downstream roller 104 to change in position. Therefore, the fixing device 9 in the first embodiment is superior to the fixing device 9H, or the first example of comparative fixing device, in terms of the airtightness between the external heat belt 105 and fixation roller 101, when the external heat belt 105 is kept in contact with the fixation roller 101. Further, as the external heat belt 105 is moved away from the fixation roller 101, the downstream roller 104 is moved away from the upstream roller 103, continuing thereby to provide the external heat belt 105 with a preset amount of tension, preventing thereby the external heat belt 105 from slackening.

<Comparison between Fixing Device 9 in First Embodiment, and Second Example of Comparative Fixing Device>

Referring to FIG. 7(*a*), unlike the fixing device 9 in the first embodiment, a fixing device 9I which is the second example of comparative fixing device is structured so that as the external heat belt 105 is moved away from the fixation roller 101, the downstream roller 104 is allowed to move in the upstream or downstream direction in terms of the rotational direction of the fixation roller 101 while the upstream roller 103 is fixed in position. In the case of the fixing device 9I, or the second example of comparative fixing device, as the external heat belt 105 is placed in contact with the fixation roller 101, the axle of the upstream roller 103 is kept fixed in position by the bearing holder 220. Instead, the axle of the downstream roller 104 is allowed to move toward the upstream roller 103 until it automatically becomes fixed in position as the width (length in terms of rotational direction of fixation roller 101) of the area of contact between the external heat belt 105 and fixation roller 101 reaches a preset value. That is, the axle of the downstream roller 104 is placed in the position where the gap 303*c* between the top section 221 of the bearing holder 220 and the bearing 104*e* for the downstream roller 104 is virtually zero.

In the case of the second example of comparative fixing device, the upstream roller is allowed to change in position as a tension roller. Therefore, the downstream roller is subjected to such force that acts in the direction to move the downstream roller away from the upstream roller. That is, such force that acts in the direction to increase the distance between the axle of the upstream roller 103 and the axle of the downstream roller 104, even though when the external heat belt 105 is in contact with the fixation roller 101, the distance between the axle of the upstream roller 103 and the axle of the downstream roller 104 has to be less than when the external heat belt 105 is kept separated from the fixation roller 101.

That is, as the external heat belt 105 is circularly moved by the rotation of the fixation roller 101, the downstream roller 104 is subjected to such force that works in the direction indicated by an arrow mark X. Consequently, the distance between the axle of the upstream roller 103 and the axle of the downstream roller 104 is slightly increased, increasing thereby the external heat belt 105 in tension. Thus, the area of contact between the external heat belt 105 and fixation roller 101 reduces in size. Therefore, in order to keep the external heat belt 105 airtightly in contact with the fixation roller 101 by the preset amount of nip length, against the above described additional amount of tension, the compression spring 204 has to be increased in the amount of pressure it can generate. However, increasing the compression spring 204 in the amount of pressure it can generate increases the amount of the stress to which the external heat belt 105 is subjected. This is not desirable.

Further, as the external heat belt 105 is circularly moved by the rotation of the fixation roller 101, the downstream roller 104 might oscillate in the direction parallel to the direction indicated by the arrow mark X, which in turn might change the external heat belt 105 in tension. The change in the tension of the external heat belt 105 changes the contact pressure between the external heat belt 105 and fixation roller 101, at the upstream roller 103 and downstream roller 104, causing thereby the entirety of the nip Ne to change in the state of contact between the external heat belt 105 and fixation roller 101. The change in the nip Ne in the state of contact between the external heat belt 105 and fixation roller 101 makes the external heat belt 105 nonuniform in temperature, which is undesirable.

In comparison, in the first embodiment, the fixing device 9 is structured so that the endless belt suspended and kept stretched by two rollers is placed in contact with, or separated from, the fixation roller 101, and also, so that one of the rollers by which the endless belt is suspended is utilized as a tension roller, and is kept pressed in the direction to increase the distance between itself and the other roller. Further, the axle of the downstream roller is fixed in position.

Referring to FIG. 7(*b*), in the case of the fixing device 9 in the first embodiment, the downstream roller 104 is fixed in position. Therefore, the downstream roller 104 does not move in the direction indicated by the arrow mark X, nor does it vibrate. Thus, even if the downstream roller 104 is subjected to such force that acts in the direction indicated by the arrow mark X, the axle of the downstream roller 104 never changes in position, and therefore, it does not affect the external heat belt 105 in tension. Therefore, it does not occur that the external heat belt 105 changes in tension.

Also in the case of the fixing device 9 in the first embodiment, the downstream roller 104 is fixed in position by the bearing holder 220. Therefore, it does not move when the external heat belt 105 is placed in contact with the fixation roller 101. However, gaps are provided between the bearing of the upstream roller 103 and bearing holder 220. Therefore, as the external heat belt 105 is placed in contact with the fixation roller 101, the upstream roller 103 is allowed to move to the position in which it causes the external heat belt 105 to airtightly contact the fixation roller 101, by the desired nip length, while reducing the distance 303*b* between the top section 221 of the bearing holder 220 and the bearing of the upstream roller 103 to virtual zero.

Further, as the external heat belt 105 is circularly moved by the rotation of the fixation roller 101, the upstream roller 103 is subjected to such force that acts in the direction indicated by an arrow mark Y, improving the area of contact between the external heat belt 105 and fixation roller 101 in airtightness. That is, even if the compression spring 204 is not increased in the amount of pressure it generates, it is ensured that the external heat belt 105 is kept airtightly in contact with the fixation roller 101. Further, as the upstream roller 103 is moved in the direction indicated by the arrow mark Y, the external heat belt 105 is reduced in the amount of tensional stress, which is desirable. Since it is unnecessary to increase the compression spring 204 in the amount of pressure it generates, the amount of the stress to which the external heat belt 105 in the first embodiment is subjected is smaller than that to which the external heat belt 105 of the second example of comparative fixing device 9I, Therefore, the external heat belt 105 in this embodiment is longer in service life than the external heat belt 105 of the second example of comparative fixing device.

The inward movement of the bearing 103*e* of the upstream roller 103 is regulated by the top section 221 of the bearing holder 220, so that it is not allowed to move inward of the external heating unit beyond position where it keeps the external heat belt 105 airtightly in contact with the fixation roller 101 by the present nip width (heat transfer area width). Therefore, it does not occur that because the upstream roller 103 is limitlessly pulled in the direction of the arrow mark Y, the external heat belt 105 fails to be kept airtightly in contact with the fixation roller 101, by the preset nip width.

In the case of the fixing device 9 in the first embodiment structured to supply the fixation roller 101 with supplemental heat, pressure is applied between the axle of the upstream roller 103 and downstream roller 104 in such a direction to increase the distance between the two rollers 103 and 104. Further, the upstream roller 103 is enabled to change in position, while the downstream roller 104 is fixed in position. Therefore, it does not require a large amount of pressure to keep the external heat belt 105 airtightly in contact with the fixation roller 101, and also, the external heat belt 105 remains stable in its circular movement. In addition, the external heat belt 105 suspended and kept tensioned by the upstream roller 103 and downstream roller 104 does not slacken when the external heat belt 105 is moved away from the fixation roller 101 as the image forming apparatus 100 is put on standby. Further, as the external heat belt 105 is separated from the fixation roller 101, it remains tensioned, being not allowed to slacken. Therefore, the fixing device 9 in this embodiment is smaller in the distance by which the external heating unit has to be moved away from the fixation roller 101 to keep the external heat belt 105 separated from the fixation roller 101, than the second example of comparative fixing device. Therefore, the former is smaller in the amount of space necessary for the positional change of the external heat belt 105, being therefore less in the vertical dimension, than the latter. That is, as is evident from the detailed description of the comparison between the fixing device 9 in the first embodiment and second example of comparative fixing device, the present invention can eliminate the problem which the second example of comparative fixing device suffers, that is, the problem that the slackening of the external heat belt 105, which occurs as the external heat belt 105 is separated from the fixation roller 101, requires a substantial amount of space for the positional movement of the external heat belt 105.

The fixing device 9 in the first embodiment is smaller in the distance by which the external heating unit has to be moved away from the fixation roller 101 to separate the external heat belt 105 from the fixation roller 101, and also, the amount of pressure to be applied to keep the external heat belt 105 airtightly in contact with the fixation roller 101, and is stabler in the circular movement of the external heat belt 105, than the second example of the comparative fixing device. Further, in the case of the fixing device 9 in the first embodiment, the force generated by the rotation of the fixation roller 101 does not act in the direction to widen the distance between the axle of the upstream roller 103 and the axle of the downstream roller 104. Therefore, the fixing device 9 in this embodiment is smaller in the amount of the pressure required to keep the external heat belt 105 airtightly in contact with the fixation roller 101 than the second example of comparative fixing device. The stability in the circular movement of the external heat belt 105 is essential to the stability in the steering of the external heat belt 105, which will be described next.

<Steering Mechanism>

Figure 8:
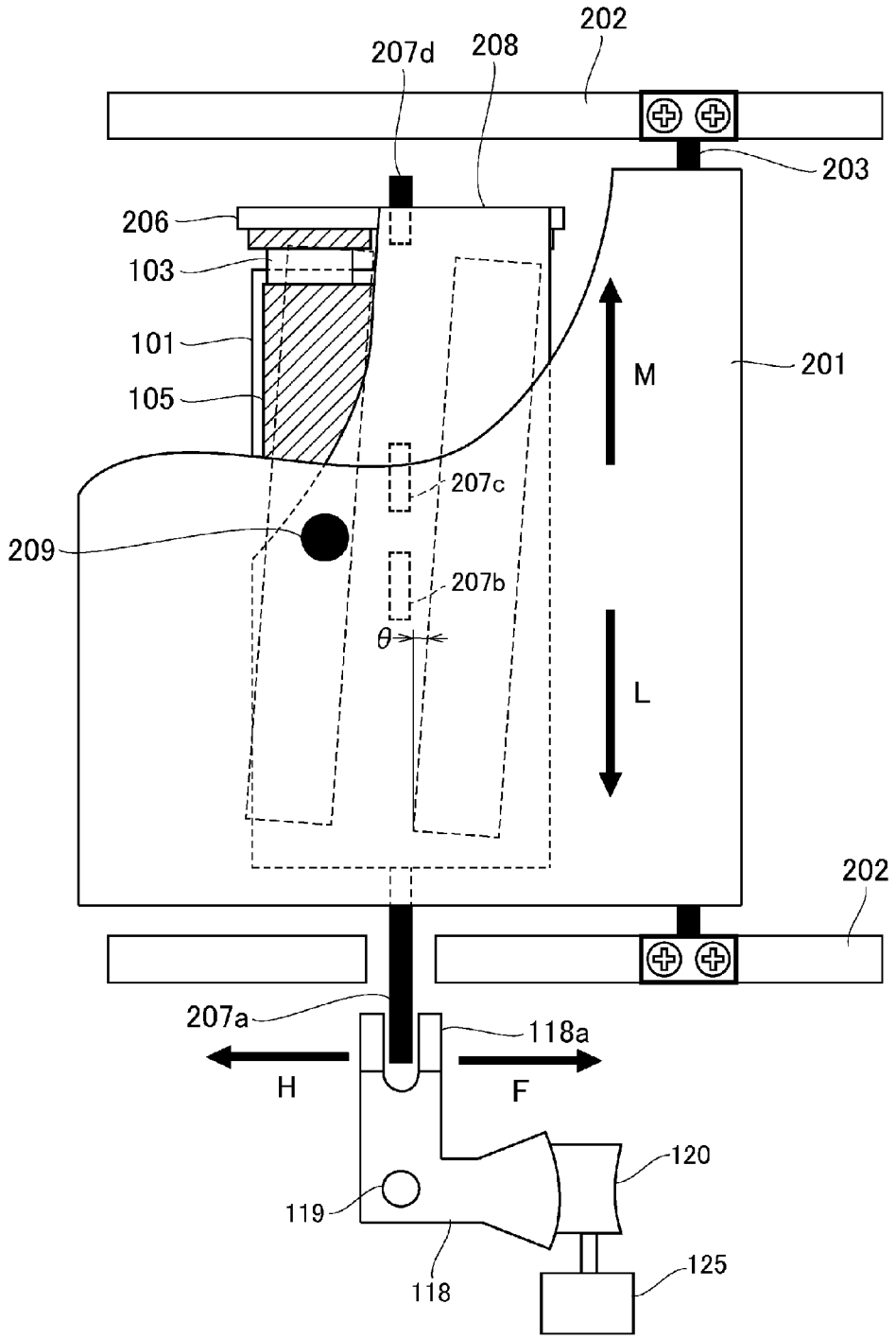
FIG. 8 is a drawing for describing the mechanism for steering the external heat belt.
Figure 9:
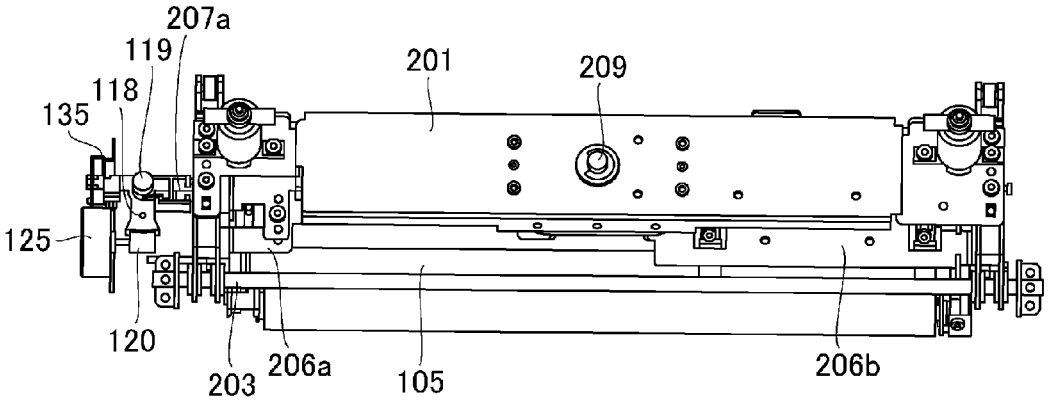
FIG. 9 is a drawing for describing the driving section of the steering mechanism.
Figure 10:
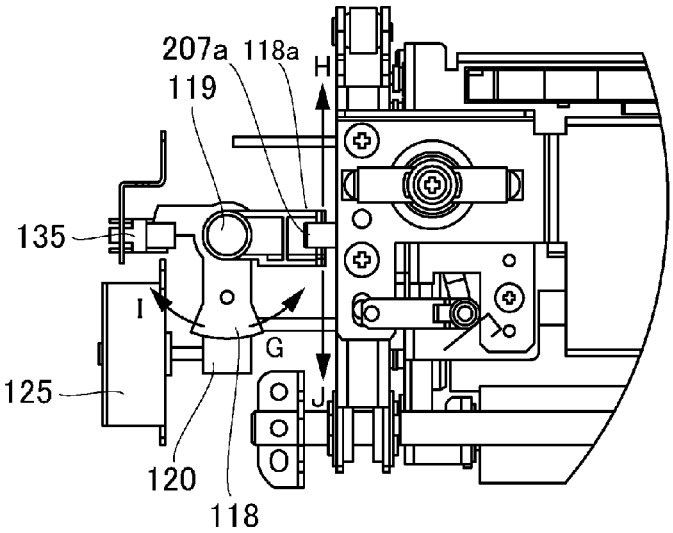
FIG. 10 also is a drawing for describing the driving section of the steering mechanism.

FIG. 8 is a drawing for describing the mechanism for steering the external heat belt 105. FIG. 9 is a drawing for describing the driving section of the external heat belt steering mechanism. FIG. 10 is an enlarged view of the external heat belt steering mechanism.

Referring to FIG. 3, if the upstream roller 103 and downstream roller 104 are not parallel to each other, the external heat belt 105 shifts in the direction parallel to the upstream roller 103 or downstream roller 104 as it is circularly moved. Thus, the fixing device 9 is structured so that the external heat belt 105 oscillates in its widthwise direction. That is, the fixing device 9 is provided with a belt steering mechanism which keeps the oscillatory movement of the external heat belt 105 within a preset range, by externally and forcefully changing the angle θ between the external heat belt 105 and fixation roller 101. More specifically, the fixing device 9 is structured so that the upstream roller 103 and downstream roller 104, by which the external heat belt 105 is suspended, can be pivotally moved together about a shaft (pivot) 209 to change the angle θ between the external heat belt 105 and fixation roller 101 to control the direction in which the external heat belt 105 laterally shifts. The shaft 209 is the pivot about which the external heat belt 105 is pivotally moved to change the angle between the external heat belt 105 and fixation roller 101.

Next, referring to FIG. 8, the shaft 209 is positioned so that its axial line becomes perpendicular to the area of contact between the fixation roller 101 and external heat belt 105. Thus, the angle θ between the external heat belt 105 and fixation roller 101 is set about the center of the shaft 209. The shaft 209 which supports the pressure application frame 201 is attached to the lateral plates 202 by its lengthwise ends. The oscillatory frame 208 and external heat belt 105 can be pivotally moved together relative to the pressure application frame 201, about the shaft 209. The shaft **207*a* fixed to the oscillatory frame 208 in such a manner that a preset amount of clearance is provided between one of the lateral plates 202 of the main frame of the fixing device 9. Thus, the shaft 207*a*** is allowed to move in the direction indicated by an arrow mark H, or the direction indicated by an arrow mark J, within the range of the clearance.

Next, referring to FIG. 9, a worm wheel 118, which is pivotally movable about a shaft 119, is in mesh with a worm gear 120.

Referring to FIG. 10, as a motor 125 rotates the worm wheel 118 in the direction indicated by an arrow mark G by rotating in its normal direction, the arm section **118*a* of the worm wheel 118 moves in the direction indicated by an arrow mark H, moving thereby the shaft 207*a* in the direction indicated by the arrow mark H. As the motor 125 rotate the worm wheel 118 in the direction indicated by an arrow mark I by reversely rotating, the arm section 118*a* moves in the direction indicated by an arrow mark J, moving thereby the shaft 207*a*** in the direction indicated by the arrow mark J.

Referring to FIG. 8, the front side of the oscillatory frame 208 moves in the direction indicated by the arrow mark H, or J, the upstream roller 103 and downstream roller 104 pivotally move together about the shaft 209, whereby their angles θ relative to the fixation roller 101 are set. The angle θ is equal to the angle between the direction in which the external heat belt 105 is driven by the friction between the fixation roller 101 and external heat belt 105, at the area of contact between the fixation roller 101 and external heat belt 105, and the direction in which the external heat belt 105 is circularly moved by the friction.

Therefore, there is a relationship between the angle θ between the fixation roller 101 and external heat belt 105, and the speed of the lateral shift of the external heat belt 105. Thus, the speed at which the external heat belt 105 laterally shifts along the upstream roller 103 and downstream roller 104 can be controlled by externally controlling the angle θ between the fixation roller 101 and external heat belt 105.

In a case where the shaft **207*a* is moved in the direction indicated by the arrow mark H from a point at which the amount of the force which acts in the direction to laterally shift the external heat belt 105 is zero, the force which acts in the direction to shift the external heat belt 105 rearward of the fixation roller 101 (direction indicated by arrow mark M) increases. In a case where the shaft 207*a* is moved in the direction indicated by the arrow mark J from a point at which the amount of the force which acts in the direction to laterally shift the external heat belt 105 is zero, the force which acts in the direction to shift the external heat belt 105 frontward of the fixation roller 101 (direction indicated by arrow mark L) increases. That is, the direction in which the external heat belt 105 shifts can be controlled by moving the shaft 207*a*** in the direction indicated by the arrow mark H or J.

<Sensor for Detecting Amount of Lateral Shift of External Heat Belt>

Figure 11:
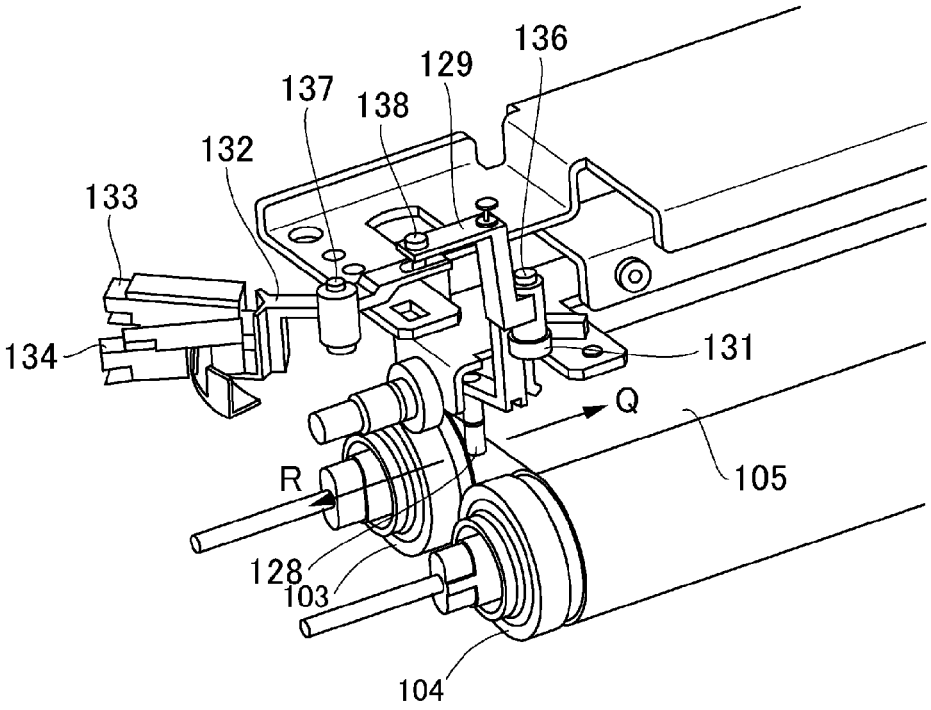
FIG. 11 is a drawing for describing the positioning of the sensor for detecting the amount of the lateral movement of the external heat belt.
Figure 12:
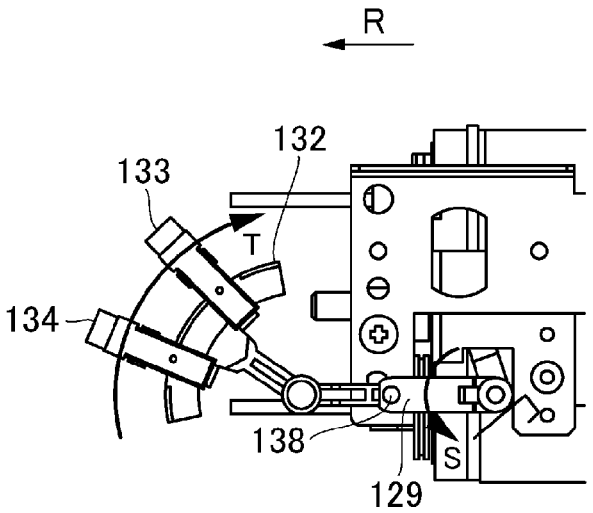
FIG. 12 is a drawing for describing the relationship between the lateral movement of the external heat belt, and the rotational direction of the sensor flag.
Figure 12:
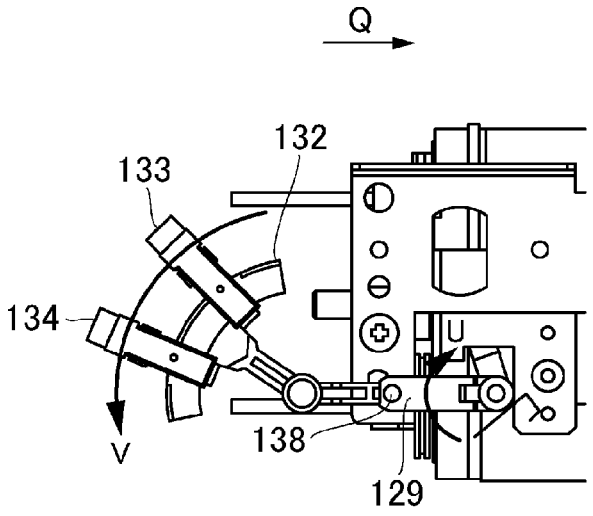

FIG. 11 is a drawing for describing the sensor for detecting the amount of the lateral shift of the external heat belt 105. FIG. 12 is a drawing for describing the relationship between the direction of the lateral belt shift, and the direction in which the sensor flag is rotated.

Referring to FIG. 11, an arm 129 and a roller 128 rotate together about a shaft 136. A sensor flag 132 rotates about a shaft 137. The arm 129 and sensor flag 132 are in connection with each other through a linkage 138. They transmit the pivotal movement of the sensor flag 132.

The roller 128 is in contact with one of the edges of the external heat belt 105. A torsional spring 131 provides the arm 129 with a preset amount of torque, keeping thereby the roller 128 torqued in the direction indicated by an arrow mark Q. Thus, as the external heat belt 105 shifts in the direction indicated by the arrow mark Q, the linkage 138 is moved in the direction indicated by an arrow mark P. As the external heat belt 105 shifts in the direction indicated by the arrow mark R, the linkage 138 is moved in the direction indicated by an arrow mark O.

There are disposed a pair of photo-interrupters 133 and 134, in line with the sensor flag 132. As they detect one of the four edges of a pair of slits with which the sensor flag 132 is provided, it reverses its output. The fixing device 9 is structured so that there is positional correlation between the four edges of the sensor flag 132 and one of the lateral edges of the external heat belt 105. For example, the photo-interrupters 132 and 133 are positioned so that the external heat belt 105 oscillates in its widthwise direction by an amplitude of 5 mm.

Next, referring to FIG. 12(*a*), as the external heat belt 105 shifts in the direction indicated by the arrow mark R, the arm 129 is rotated in the direction indicated by an arrow mark S, causing thereby the sensor flag 132 to rotate in the direction indicated by an arrow mark T. Consequently, the photo-interrupter 133 is turned off, and the photo-interrupter 134 is turned on.

Referring to FIG. 12(*b*), as the external heat belt 105 shifts in the direction indicated by the arrow mark Q, the arm 129 is rotated in the direction indicated by an arrow mark V, causing thereby the sensor flag 132 to rotate in the direction indicated by an arrow mark V. Consequently, the photo-interrupter 133 is turned on, and the photo-interrupter 134 is turned off.

<Control of Steering Mechanism>

Figure 13:
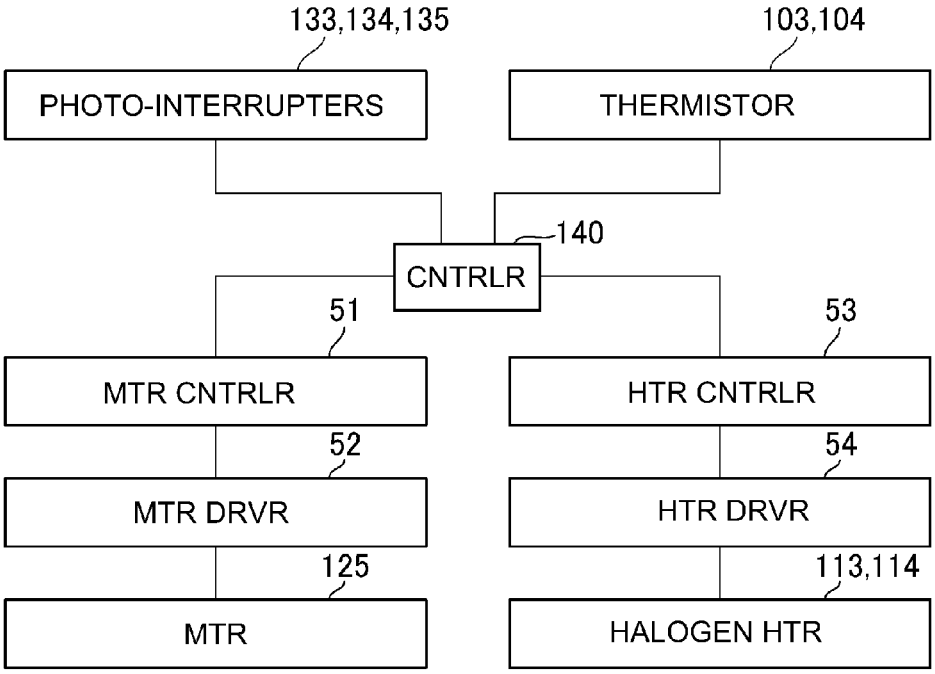
FIG. 13 is a block diagram of the control section of the fixing apparatus.
Figure 14:
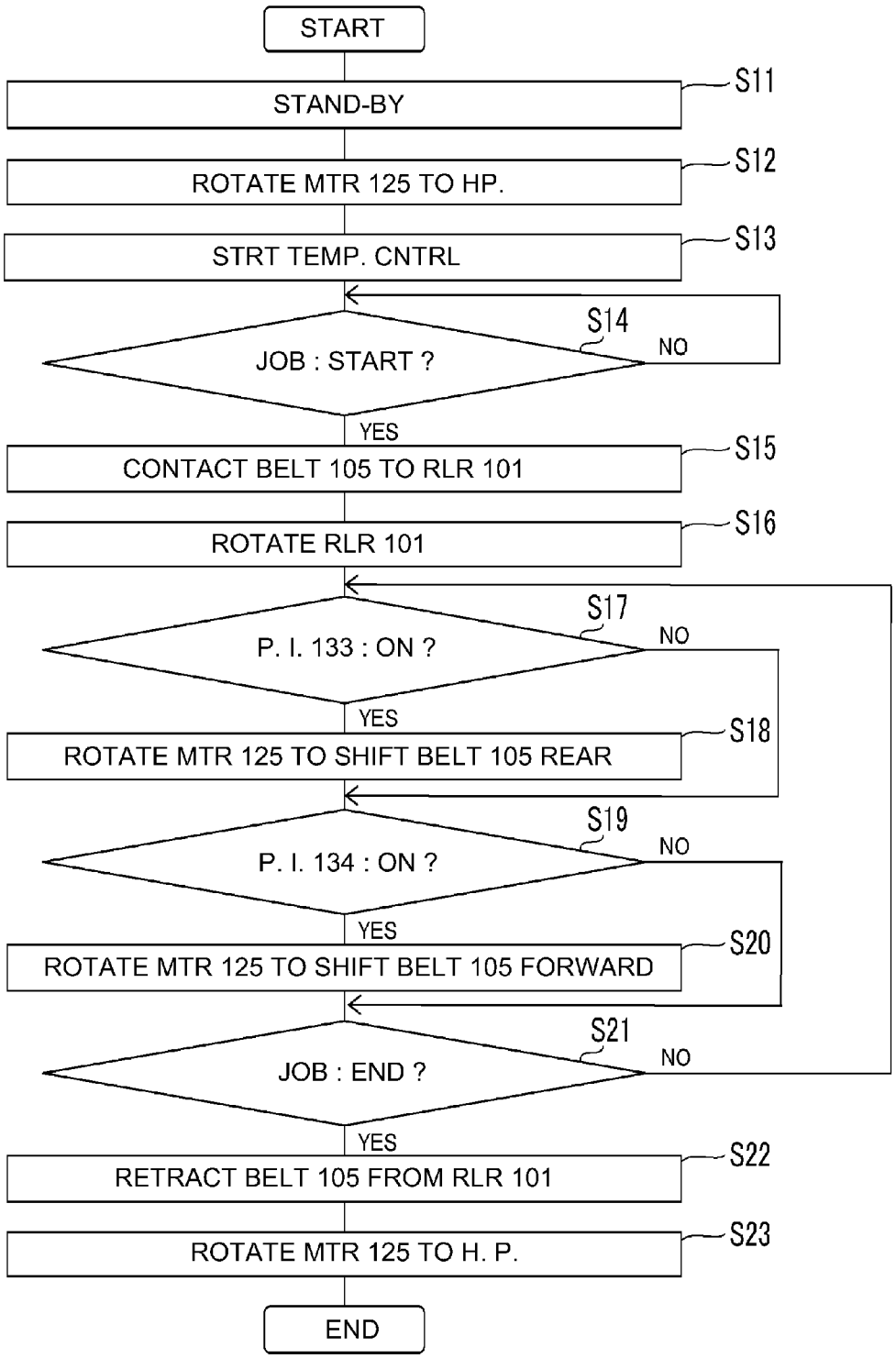
FIG. 14 is a flowchart of the control sequence of the steering of the external heat belt.

FIG. 13 is a block diagram of the system for controlling the fixing device. FIG. 14 is a flowchart of the control sequence for the mechanism for steering the external heat belt 105. Referring to FIG. 8, the motor 125, which is an example of a rotational mechanism, rotates the upstream roller 103 and downstream roller 104 together in parallel to the top portion of the loop which the external heat belt 105 forms. The motor 125 is enabled to change the angle of the fixation roller 101 relative to the upstream roller 103 and downstream roller 104. Referring to FIG. 11, the photo-interrupters 133 and 134, which are examples of detecting means, detect the position of the external heat belt 105 relative to the upstream roller 103 and downstream roller 104. Referring to FIG. 13, the control section 140, which is an example of controlling means, controls the lateral shift of the external heat belt 105, by activating the motor 125 in response to the results of the detection of the position of the external heating belt 105 by the photo-interrupters 133 and 134.

Referring to FIG. 13 along with FIG. 8, the control section 140 controls the lateral shifts of the external heat belt 105, by controlling the motor 125 through a motor controller 51 and a motor driver 52. The control section 140 determines the position of the external heat belt 105, based on the outputs of the photo-interrupters 133 and 134.

As the external heat belt 105 shifts frontward to a preset point, the control section 140 moves the shaft 207*a* in the direction indicated by the arrow mark H, by activating the motor 125. Consequently, such force that acts in the direction to shift the external heat belt 105 rearward is generated. On the other hand, as the external heat belt 105 shifts rearward to a preset point, the control section 140 moves the shaft 207*a* in the direction indicated by the arrow mark J, by activating the motor 125. Consequently, such force that acts in the direction to shift the external heat belt 105 frontward is generated.

Referring to FIG. 13, the photo-interrupter 135 detects the home position of the worm wheel 118, by activating the motor 125. The home position of the worm wheel 118 is the position in which the worm wheel 118 keeps the upstream roller 103 and downstream roller 104 parallel to the fixation roller 101.

Referring to FIG. 8, as the fixation roller 101 is rotated, the external heat belt 105 is circularly moved by the rotation of the fixation roller 101 while being shifted frontward or rearward. As the external heat belt is laterally shifted, the control section 140 moves the shaft 207*a* in the direction to cause the friction between the external heat belt 105 and fixation roller 101 to shift the external heat belt 105 in the opposite direction from the direction in which the external heat belt 105 has been shifting. The fixing device 9 is structured so that the distance by which the shaft 207 is movable from in its home position in the direction indicated by the arrow mark H or J is no more than 2 mm.

Next, referring to FIG. 14 along with FIG. 13, as the image forming apparatus 100 is put on standby (S11), the control section 140 reduces the angle θ of the external heat belt 105 relative to the fixation roller 101 to zero, by activating the motor 125, and determines the home position of the worm wheel 118 with the use of the photo-interrupter 135 (S12). Then, the control section 140 begins to control the fixation roller 101, pressure roller 102, upstream roller 103, and downstream roller 104 in temperature by supplying the halogen heaters 111 and 112 with electrical current (S13). As an image forming job is started (Yes in S14), the control section 140 places the external heat belt 105 in contact with the fixation roller 101, by rotating the pressure removal cam 205 (S15). Thus, the external heat belt 105 is rotated by the rotation of the fixation roller 101.

If the photo-interrupter 133 is turned off by the frontward shifting of the external heat belt 105 (Yes in S17), the control section 140 shifts the shaft 207*a* in the direction to cause the external heat belt 105 to shift rearward, by activating the motor 125 (S18). If the photo-interrupter 134 is turned off by the rearward shifting of the external heat belt 105 (Yes in S19), the control section 140 shifts the shaft 207*a* in the direction to cause the external heat belt 105 to shift frontward, by activating the motor 125 (S20).

The control section 140 continues to controls the lateral shifting of the external heat belt 105 (S17-S21) until the image formation job is ended (No in S21). As the image formation job is ended (Yes in S21), the control section 140 moves the external heat belt 105 away from the fixation roller 101 by rotating the pressure removal cam 205 (S22).

Then, the control section 140 places the worm wheel 118 in the home position (reducing thereby angle θ of fixation roller 101 relative to upstream roller 103 and downstream roller 104 to virtually zero (0°)), by activating the motor 125 while checking whether the worm wheel 118 is in the home position or not, with the use of the photo-interrupter 135. Then, it stops the motor 125 (S23).

<Cleaning Roller>

Figure 15:
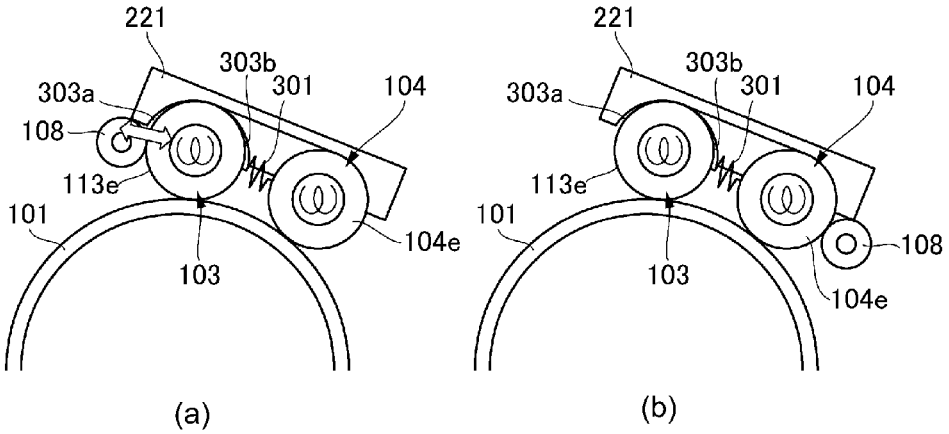
FIG. 15 is a drawing for describing the positioning of the cleaning roller.

FIG. 15 is a drawing for describing the positioning of a cleaning roller, which is a rotational cleaning component. Referring to FIG. 3, the surface layer of the external heat belt 105 is contaminated by the adhesion of unwanted substances, such as the toner and/or paper dust which transfer (offset), to the external heat belt 105 from recording medium. Therefore, the cleaning roller 108 for cleaning the surface layer of the external heat belt 105 is necessary. The cleaning roller 108 has a surface layer which is formed of silicon rubber, and to which the toner and/or paper dust is to be adhered. The cleaning roller 108 is kept pressed upon the external heat belt 105 by an unshown pressure application mechanism, and cleans the surface of the external heat belt 105 while being rotated by the circular movement of the external heat belt 105.

It is desired that the cleaning roller 108 is positioned so that as the cleaning roller 108 is placed in contact with the external heat belt 105, it is pressed against the upstream roller 103 or downstream roller 104 with the presence of the external heat belt 105 between the cleaning roller 108 and the upstream roller 103 or downstream roller 104. With the external heat belt 105 being supported by the upstream roller 103 and downstream roller 104, from the inward side of the belt loop, the fixing device 9 is increased in the airtightness of the area of contact between the cleaning roller 108 and external heat belt 105, which in turn increases the cleaning roller 108 in cleaning performance.

Next, referring to FIG. 15(*a*), in the case of the third example of comparative fixing device, the cleaning roller 108 is pressed against the upstream roller 103 which is movable relative to the baring holder 220 as in the case of the fixing device 9 in the first embodiment. Thus, it is more likely for the distance between the axle of the upstream roller 103 and the axle of the downstream roller 104 to be changed by the displacement and/or vibration of the upstream roller 103, which is attributable to the rotation of the fixation roller 101.

The fluctuation in the distance between the axle of the upstream roller 103 and the axle of the downstream roller 104 changes the external heat belt 105 in tension, which in turn is likely to make the external heat belt 105 unstable in circular movement. With the external heat belt 105 being unstable in its circular movement, it is difficult to reliably control the lateral shift of the external heat belt 105, with the use of the above-described belt steering mechanism.

The change in position, and/or vibration, of the upstream roller 103, which is attributable to the rotation of the fixation roller 101, occurs at both lengthwise ends of the upstream roller 103. Further, the occurrence of the change in position, and/or vibration, of the upstream roller 103 at one lengthwise end of the upstream roller 103 is independent from that at the other end. Therefore, the distance between the axle of the upstream roller 103 and the axle of the downstream roller 104 is likely to be nonuniform in terms of the lengthwise direction. If the distance between the axle of the upstream roller 103 and the axle of the downstream roller 104 become nonuniform in terms of the lengthwise direction, the nonuniformity affects the lateral shift of the external heat belt 105, interfering thereby the control of the lateral shift of the external heat belt 105 by the above described belt steering mechanism. In the second embodiment of the present, therefore, the cleaning roller 108 is pressed against the downstream roller 104, the axle of which is fixed to the roller supporting frame 206.

Embodiment 2

Figure 16:
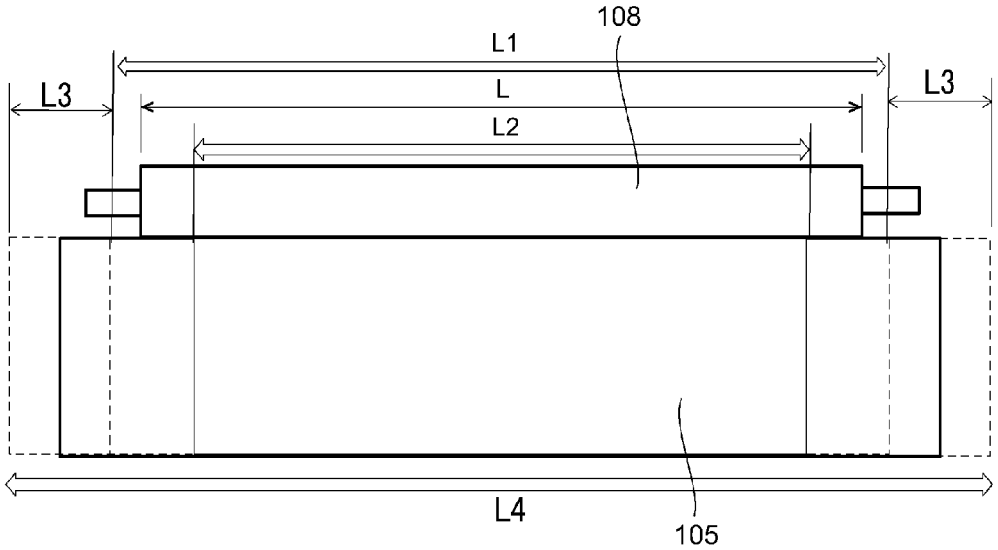
FIG. 16 is a drawing for describing the cleaning range of the cleaning roller.

FIG. 16 is a drawing for describing the cleaning range of the cleaning roller 108. Referring to FIG. 15(*b*), in the second embodiment, the cleaning roller 108, which is an example of a rotational cleaning component, is rotatably supported by the roller supporting frame 206 by its axle. The cleaning roller 108 sandwiches the external heat belt 105 between itself and the downstream roller 104. It cleans the external heat belt 105 as it is rotated. The sum of the radius of the cleaning roller 108, thickness of the external heat belt 105, and radius of the downstream roller 104 is greater than the distance between the rotational axis of the cleaning roller 108 and the rotational axis of the downstream roller 104.

The axle of the downstream roller 104 and the axle of the cleaning roller 108 are fixed to the roller supporting frame 206. Therefore, even if the external heat belt 105 drastically changes in tension, the distance between the axle of the cleaning roller 108 and the axle of the downstream roller 104 is kept stable. Therefore, the pressure which the cleaning roller 108 applies to the downstream roller 104 through the external heat belt 105 does not change. Therefore, the load to which the external heat belt 105 is subjected as it is circularly moved by the rotation of the downstream roller 104 remains stable. Therefore, the external heat belt 105 remains stable in its circular movement.

In the first embodiment, the fixing device 9 is structured so that the upstream roller 103 is changeable in position. Therefore, it is unlikely for the external heat belt 105 to change in tension. Therefore, the external heat belt 105 is stable in its circular movement in the first place. Thus, the structural arrangement for the fixing device 9 in the second embodiment is synergetic to that in the first embodiment in terms of the stabilization of the circular movement of the external heat belt 105. In the case of the second embodiment, therefore, the external heat belt 105 is kept even more airtightly in contact with the fixation roller 101 than in the case of the first embodiment. Therefore, the external heating unit in the second embodiment is more uniform in the heat transfer, and higher in heat transfer efficiency, across the area of contact between the external heat belt 105 and fixation roller 101, than the external heating unit in the first embodiment. Therefore, the former is less in the fluctuation of the surface temperature of the fixation roller 101, which occurs as recording medium is conveyed through the nip Ne, than the latter.

Referring to FIG. 16, in the second embodiment, the length of the cleaning roller 108 in terms of the direction parallel to the rotational axis of the cleaning roller 108 is greater than the dimension (in terms of direction perpendicular to recording medium conveyance direction) of the largest sheet of recording medium feedable to the fixing device 9. The length of the cleaning roller 108 in terms of the direction parallel to the rotational axis of the cleaning roller 108 is set so that both of the lengthwise ends of the cleaning roller 108 will be within the range in which the external heat belt 105 is laterally oscillated.

A referential code L2 stands for the maximum range, in which an image can be formed, that is, the maximum range in which toner adheres to the external heat belt 105. A referential code L3 stands for the range in which the edges of the external heat belt 105 are kept by the mechanism for steering the external heat belt 105. A referential code L1 stands for the range in which toner adheres to the external heat belt 105 while the external heat belt 105 is steered by the steering mechanism. A referential code L4 stands for the range in which the external heat belt 105 is kept by the belt steering mechanism.

The outwardly facing surface of the external heat belt 105 has to be cleaned across the entirety of its image formation range by the cleaning roller 108. Therefore, the length L of the cleaning roller 108 is greater than the length L2 of the maximum image formation range. Further, in order to prevent the lateral edges of the external heat belt 105 from being moved inward of the lengthwise ends of the cleaning roller 108 by the steering of the external heat belt 105, the length L of the cleaning roller 108 is made less than the distance L between the point at which the front lateral edge of the external heat belt 105 is when the external heat belt 105 is in the most rearward position, and the point at which the rear lateral edge of the external heat belt 105 is when the external heat belt 105 is in the most frontward position, for the following reason.

That is, the moment one of the lengthwise ends of the cleaning roller 108 moves out of the range in which the external heat belt 105 is allowed to snake, the external heat belt 105 suddenly changes in terms of how it laterally shifts. Further, if the external heat belt 105 is changed in the direction of it lateral oscillation while one of the lengthwise ends of the cleaning roller 108 is outside the range in which the external heat belt 105 is allowed to snake, the edge portion of the external heat belt 105 bite into the cleaning roller 108, which is relatively soft. Thus, it is possible that the external heat belt 105 will change in the manner in which it laterally shifts, and/or that it will become impossible for the external heat belt 105 to be controlled in lateral movement as intended.

This is why the length L of the cleaning roller 108 is set to satisfy an inequality: L1>L>L2, and the cleaning roller 108 is disposed as shown in FIG. 16. Therefore, the cleaning roller 105 is enabled to satisfactorily clean the external heat belt 105, and allow the external heat belt 105 to remain stable in circular movement while being controlled in lateral shift.

In the second embodiment, the cleaning roller 108 is pressed against the downstream roller 104 with the presence of the external heat belt 105 between itself and the downstream roller 104. Therefore, the pressure applied to the external heat belt 105 by the downstream roller 104 and cleaning roller 108 is uniform across the lengthwise direction of the fixing device 9. Therefore, the cleaning roller 108 does not significantly affect the control of the external heat belt 105 by the above-described belt steering mechanism in terms of the lateral shift. Therefore, it is assured that the external heat belt 105 remains stable in its circular movement.

Also in the second embodiment, the distance between the axle of the cleaning roller 108 and the axle of the downstream roller 104 does not change. Therefore, the external heat belt 105 does not change in tension. Therefore, it does not occur that the external heat belt 105 is made unstable in its circular movement by the instability in the tension of the external heat belt 105, which is attributable to the change in the distance between the axle of the cleaning roller 108 and the axle of the downstream roller 104. Therefore, the external heat belt 105 remains stable in its circular movement. Therefore, the external heat belt 105 can be reliably controlled in its lateral movement by the above-described belt steering mechanism.

Also in the second embodiment, the length L of the cleaning roller 108 is set as shown in FIG. 16. Further, the cleaning roller 108 is positioned as shown in FIG. 16. Therefore, the fixing device 9 in the second embodiment is more stable in the control of the external heat belt 105 by the above-described belt steering mechanism in terms of the lateral shift of the external heat belt 105.

The foregoing is the description of the embodiments of the present invention. However, the present invention can be embodied in the different forms from those in the preceding embodiments, by partially or entirely replacing the structural components of the fixing devices in the preceding embodiments, with some of the known structural components.

That is, the means for heating the fixation roller, external heat belt, etc., does not need to be limited to a halogen heater. For example, a heating means based on the electromagnetic induction may be employed in place of the halogen heater. Further, a fixation belt may be employed in place of the fixation roller.

In the foregoing description of the embodiments of the present invention, the image heating apparatus (device) was described as a fixing apparatus (device). However, the present invention is also applicable to an apparatus for heating an incompletely fixed image or a fixed image to adjust the image in surface properties such as glossiness. Further, it is also applicable to an apparatus for flattening a sheet of recording medium after the fixation of an image to the sheet of recording medium caused the sheet to curl. Not only can an image heating apparatus in accordance with the present invention be employed as a part of an image forming apparatus, but also, can be employed as a heating apparatus or unit which is independently operated from an image forming apparatus. Further, not only is the present invention compatible with a full-color image forming apparatus, but also, a black-and-white image forming apparatus. Further, not only is the present invention applicable to a printer such as those in the preceding embodiments, but also, various image forming apparatuses other than the printer. That is, the present invention is compatible with a copying machine, a facsimile machine, etc., and a multifunction image forming apparatus capable of performing two or more functions of the preceding image forming apparatuses.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 210919/2012 filed Sep. 25, 2012, which is hereby incorporated by reference.

What is claimed is:

1. An image heating apparatus comprising:

first and second rotatable members configured and positioned to heat a toner image on a sheet therebetween;

an endless belt configured and positioned to heat said first rotatable member by contacting an outer surface of said first rotatable member;

first and second rollers provided inside of said endless belt and configured to rotatably support said endless belt;

a first bearing mounted on said first roller and configured to rotatably support said first roller;

a second bearing mounted on said second roller and configured to rotatably support said second roller;

a holding mechanism configured and positioned to hold said first bearing and said second bearing so as to permit movements of said first bearing relative to said second bearing in a direction away from each other; and a coil spring provided so as to directly contact said first bearing and said second bearing and configured to urge said first bearing relative to said second bearing in the direction away from each other, wherein said holding mechanism includes a spring holder extending along the direction in which said first and second bearings move away from each other and configured to hold said coil spring to regulate an expansion and contraction direction of said coil spring.

2. The apparatus according to claim 1, further comprising a moving mechanism configured and positioned to move said holding mechanism between a position in which said endless belt contacts said first rotatable member and a position in which said endless belt is spaced from said first rotatable member.

3. The apparatus according to claim 1, further comprising a driving mechanism configured and positioned to rotationally drive said first rotatable member, wherein said endless belt is rotated by rotation of said first rotatable member.

4. The apparatus according to claim 1, wherein said holding mechanism includes a hole portion configured and positioned to engage with said first bearing so as to permit the movements of said first bearing relative to said second bearing.

5. The apparatus according to claim 1, further comprising a cleaning rotatable member disposed opposed to said second roller through said endless belt and configured to clean said endless belt.

6. The apparatus according to claim 5, wherein said second roller is held by said holding mechanism so as to be substantially immovable relative to said holding mechanism.

7. The apparatus according to claim 1, further comprising a first heater provided inside of said first roller and a second heater provided inside of said second roller.

8. The apparatus according to claim 1, wherein said first rotatable member is a roller disposed in a side contacting the toner image on the sheet.

9. The apparatus according to claim 1, wherein said first roller and said second roller urge said endless belt toward first rotatable member so that said endless belt contacts the outer surface of said first rotatable member.

10. The apparatus according to claim 1, wherein said first roller and said second roller are disposed inside said endless belt in this order along a rotational moving direction of said first rotatable member.

* * * * *